US009476193B2

(12) United States Patent
Kitaura et al.

(10) Patent No.: US 9,476,193 B2
(45) Date of Patent: Oct. 25, 2016

(54) FLUSH TOILET APPARATUS

(71) Applicant: TOTO LTD., Fukuoka (JP)

(72) Inventors: Hidekazu Kitaura, Kitakyushu (JP); Ryoko Ishimaru, Kitakyushu (JP); Tomohiro Iwabata, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 174 days.

(21) Appl. No.: 14/228,072

(22) Filed: Mar. 27, 2014

(65) Prior Publication Data

US 2014/0289950 A1 Oct. 2, 2014

(30) Foreign Application Priority Data

Mar. 27, 2013 (JP) ..... 2013-066973
Sep. 30, 2013 (JP) ..... 2013-202881
Sep. 30, 2013 (JP) ..... 2013-203785

(51) Int. Cl.

| | |
|---|---|
| ***E03D 11/00*** | (2006.01) |
| ***E03D 1/08*** | (2006.01) |
| ***E03D 1/06*** | (2006.01) |
| ***E03D 1/00*** | (2006.01) |
| ***E03D 5/01*** | (2006.01) |
| ***E03D 11/08*** | (2006.01) |

(52) U.S. Cl.
CPC ..... *E03D 5/01* (2013.01); *E03D 11/08* (2013.01); *E03D 2201/40* (2013.01)

(58) Field of Classification Search
CPC ..... E03D 11/08; E03D 1/085
USPC ..... 4/432, 415, 374, 377, 431, 353, 369, 4/370, 324
See application file for complete search history.

(56) References Cited

U.S. PATENT DOCUMENTS 1,259,226 A * 3/1918 Gondolf ..... E03D 1/087 4/374
2012/0227172 A1* 9/2012 Hadd ..... E03D 1/36 4/415

FOREIGN PATENT DOCUMENTS

WO 2005/106141 A1 11/2005

* cited by examiner

*Primary Examiner* — Christine Skubinna
(74) *Attorney, Agent, or Firm* — Studebaker & Brackett PC

(57) ABSTRACT

This flush toilet apparatus includes a traveling-direction switching mechanism switching a mode between a toilet washing mode and a tank storage mode. This traveling-direction switching mechanism includes: a shield portion directing jet water to an outside of a throat pipe at a time of the tank storage mode; a moving mechanism moving the shield portion from a position at a time of the toilet washing mode in a first direction to a position at the time of the tank storage mode; and a guide surface switching a traveling direction of the jet water so that after the traveling direction is switched, a flow rate of the jet water is higher in a second direction opposite to the first direction than in the first direction.

13 Claims, 17 Drawing Sheets

FLUSH TOILET APPARATUS

BACKGROUND OF THE INVENTION

1. Field of the Invention

The present invention relates to a flush toilet apparatus for washing a toilet body with wash water.

2. Description of the Related Art

There is conventionally known a flush toilet apparatus having a jet-pump water supply mechanism as a mechanism for supplying wash water to a toilet body.

This jet-pump water supply mechanism includes a tank that stores therein water, and a jet pump unit is arranged inside of the tank in a submerged state. The jet pump unit includes a throat pipe. One end of the throat pipe is connected to a channel in the direction of the bowl portion of the toilet body, and an opening is formed in the other end thereof. If the water is injected from an injection nozzle into the throat pipe through the opening, then a jet pump action is triggered to cause a large amount of water to flow toward the bowl portion inside of the throat pipe. A large amount of wash water is supplied to the toilet body since not only the water injected from the injection nozzle but also the water stored in the tank is drawn into and flows in the throat pipe.

Meanwhile, in the jet-pump water supply mechanism, there is no need to store all the water to be supplied to the toilet body in the tank as the wash water. This can advantageously make the tank smaller in size than that of a tank water supply mechanism and, therefore, reduce time necessary to fill the tank with water up to a full water level. Furthermore, even if the flush toilet apparatus is installed in an environment in which the water pressure of a water supply pipe is relatively low, it is possible to supply a large amount of wash water to the toilet body. Moreover, the jet-pump water supply mechanism is advantageous in that it is unnecessary to conduct a large-scale construction work, for example, for making the water supply pipe have a large diameter as with a direct-pressure-type flush toilet apparatus.

Furthermore, the shorter time required to fill the tank with water up to the full water level in the jet-pump water supply mechanism can, in turn, improve the continuous washing performance for continuously washing the toilet body. With views of further improving this continuous washing performance, there is known a technique for switching one jet water channel to another to switchably supply the water to the toilet body or to store the water in the tank.

For example, National Publication of International Patent Application No. 2012-528960 describes, as a technique for switching the traveling direction of jet water, a flush toilet apparatus. The flush toilet apparatus has a traveling-direction switching mechanism between a nozzle and a throat pipe, which mechanism allows switchover of the water flow direction to inject water into a throat pipe (supply wash water to a bowl portion) or to pour water into a tank. The traveling-direction switching mechanism includes a float member moving in proportion to the water level of the water stored in the tank, and a shield portion shielding jet water to prevent the jet water injected from the nozzle from flowing into the throat pipe. At a high water level, a buoyant force acts on the shield portion to cause the shield portion to be detached from a suction port of the throat pipe, and the jet water injected from the nozzle flows into the throat pipe with resistance hardly imposed on the jet water. On the other hand, at a low water level, the float member and the shield portion move downward and are located between the nozzle and the throat pipe. This can suppress the entry of the jet water into the throat pipe, whereby the jet water is poured into the tank and stored in the tank.

A flush toilet apparatus described in Japanese Patent No. 4713575 has a traveling-direction switching mechanism arranged downstream of a nozzle, that is, between a nozzle and the throat pipe, which mechanism allows switchover of the water flow direction to inject water into a throat pipe (supply wash water to a bowl portion) or to pour water into a tank. The traveling-direction switching mechanism includes a ball moving vertically in proportion to the water level of the water stored in the tank.

At a high water level, the buoyant force acts on the ball to cause the ball to be detached from the suction port of the throat pipe, and the jet water injected from the nozzle flows into the throat pipe with resistance hardly imposed on the jet water. On the other hand, at a low water level, the ball moves downward and remains between the nozzle and the throat pipe, whereby the jet water is poured into the tank and stored in the tank.

The flush toilet apparatus disclosed in National Publication of International Patent Application No. 2012-528960 is configured to switch the traveling direction of the jet water to store the water in the tank. However, the flush toilet apparatus of National Publication of International Patent Application No. 2012-528960 has the following problems. At a time of switching the toilet washing mode for supplying the jet water to the toilet body to the tank storage mode for storing the water in the tank by switching a jet-water traveling direction, a shield portion shields the jet water. The force of the jet water thereby acts on the shield portion and the shield portion is pressed against the suction port. Owing to this, even if the water level of the tank reaches one at which it is necessary to store the jet water in the tank, then the shield portion remains pressed against the suction port by the jet water, and it is impossible to instantaneously switch the toilet washing mode to the tank storage mode. Furthermore, the interference of the shield portion with the jet water causes the degradation in the jet pump action. As a result, the water that does not contribute to the toilet washing performance and the waste transport performance is supplied in vain to the toilet body, which disadvantageously increases the total flow rate of the water for use in washing.

The flush toilet apparatus disclosed in Japanese Patent No. 4713575 is configured to switch the traveling direction of jet water to store the water in the tank. Japanese Patent No. 4713575 also discloses that the ball shielding the jet water is drawn into the throat pipe by the jet water at the time of switching the toilet washing mode to the tank storage mode. However, the flush toilet apparatus of Japanese Patent No. 4713575 has the following problems. If the jet water strikes against the ball at a time of drawing the ball into the throat pipe, then the jet water striking against the ball travels irregularly, the force of the jet water acts on the ball in all directions, and it is impossible to instantaneously switch the toilet washing mode to the tank storage mode. Furthermore, the jet water which acts to draw the ball into the throat pipe is discharged to the toilet body side through the throat pipe. As a result, similarly to National Publication of International Patent Application No. 2012-528960, the water that does not contribute to the toilet washing performance and the waste transport performance is supplied in vain to the toilet body, which disadvantageously increases the total flow rate of the water for use in washing.

SUMMARY OF THE INVENTION

The present invention has been made to solve the aforementioned problems, and an object of the present invention is to provide a flush toilet apparatus capable of instantaneously switching a toilet washing mode to a tank storage mode in response to a force of jet water a traveling direction of which is switched.

To attain the object, a flush toilet apparatus according to the present invention is a flush toilet apparatus for discharging waste to a drain pipe by wash water. The flush toilet apparatus includes a toilet body including a bowl portion that receives the waste, and a water conduit for introducing water supplied as the wash water to the bowl portion; a tank storing water therein, and provided to allow supply of the water to the water conduit; and a jet pump unit arranged in a state in which at least a part of the jet pump unit is submerged inside of the tank. The jet pump unit includes a throat pipe having a suction port formed in one end portion of the throat pipe, and arranged in such a manner that the water flowing into the throat pipe from the suction port is supplied to the water conduit; a nozzle triggering a jet pump action by injecting jet water at a high flow velocity toward inside of the throat pipe from the suction port; and a traveling-direction switching mechanism switching a mode between a toilet washing mode for supplying the jet water to the water conduit and a tank storage mode for supplying the jet water into the tank by switching a traveling direction of the jet water from the inside of the throat pipe to an outside of the throat pipe. The traveling-direction switching mechanism includes a shield portion switching the traveling direction of the jet water to the outside of the throat pipe by shielding the traveling jet water at a time of the tank storage mode; and a moving mechanism moving the shield portion from a position at a time of the toilet washing mode in a first direction to a position at the time of the tank storage mode. The shield portion includes a guide surface switching the traveling direction of the jet water so that after the traveling direction is switched during the process of switching from the toilet washing mode to the tank storage mode, a flow rate of the jet water is higher in a second direction opposite to the first direction than in the first direction.

In a first invention configured as described above, the guide surface makes a flow rate of the jet water higher in a second direction (in which a force acts on the shield portion for pressing the shield portion to the position at the time of the tank storage mode) than in a first direction (in which a force acts on the shield portion for pressing the shield portion to the position at the time of the toilet washing mode) after the traveling direction is switched. It is, therefore, possible for the force for pressing the shield portion to the position at the time of the tank storage mode to act more on the shield portion. It is thereby possible to instantaneously switch the toilet washing mode to the tank storage mode in response to the force of the jet water the traveling direction of which is switched.

By instantaneously switching the toilet washing mode to the tank storage mode, the total flow rate of the water used for washing can be reduced since the time for supplying the water the flow rate of which decreases by the interference of a part of the jet water with the shield portion to the toilet body can be reduced.

According to a second invention, the guide surface is provided in an end portion in the first direction side of the shield portion so that after the traveling direction is switched, almost all the jet water travels in the second direction.

In the second invention configured as described above, by switching the traveling direction of almost all the jet water to the second direction, it is possible to increase the force in the first direction acting on the shield portion. Therefore, it is possible to instantaneously switch the toilet washing mode to the tank storage mode.

According to a third invention, the guide surface is formed to have a concave cross-section so as to suppress diffusion of the jet water after the traveling direction is switched.

In the third invention configured as described above, the diffusion of the jet water is suppressed after the traveling direction is switched, whereby it is possible for the guide surface to guide more jet water to the second direction. Therefore, the force in the first direction that the jet water acts on the shield portion increases, thereby making it possible to instantaneously switch the toilet washing mode to the tank storage mode.

According to a fourth invention, the guide surface extends to have a curve shape so as to suppress deceleration of the jet water resulting from switching of the traveling direction of the jet water.

In the fourth invention configured as described above, by suppressing the deceleration of the jet water resulting from the switching of the traveling direction of the jet water, it is possible to maintain a state in which the jet water travels at the high flow velocity. Therefore, larger force in the first direction acts on the shield portion, thereby making it possible to instantaneously switch the toilet washing mode to the tank storage mode.

According to a fifth invention, the guide surface is configured to switch the traveling direction of the jet water to the outside of the throat pipe without disturbing a flow of the jet water injected from the nozzle at a time of supplying the water into the tank by switching the traveling direction.

The guide surface switches the traveling direction of the jet water without disturbing the flow of the jet water (without striking and scattering) at the time of supplying the water into the tank. As a result, the direction of the force acting on the traveling-direction switching portion is restricted in one direction, thereby preventing the noise resulting from vibration from being generated. Furthermore, since the traveling direction of the jet water is switched to the outside of the throat pipe without disturbing the flow of the jet water, it is possible to prevent the flow of the jet water from being disturbed by striking of the jet water against the traveling-direction switching portion, to prevent the air from being mixed in the water, and to prevent the noise from being generated.

According to a sixth invention, the guide surface is configured to direct the jet water downward in the tank, the traveling direction of the jet water being switched.

Since the jet water is directed downward at the time of supplying the water into the tank, the jet water travels in the water possibly present downward inside of the tank even after the water inside of the tank is supplied to the toilet body. Resistance of the water inside of the tank is thereby applied to the jet water and the jet water is decelerated. By decelerating the jet water via the water inside of the tank, it is possible to suppress the jet water from disturbing a water surface inside of the tank and projecting from the water surface inside of the tank, and to suppress the noise resulting from these factors.

According to a seventh invention, the traveling-direction switching mechanism includes an air-contact suppression portion suppressing the jet water from contacting the air present inside of the throat pipe at the time of supplying the water into the tank.

Provided that the jet water contacts the air inside of the throat pipe, the jet water draws in the air inside of the throat pipe by suction at the time of supplying the water into the tank because of the high flow velocity, resulting in the generation of the noise. In the preferred embodiment, by contrast, by providing the air-contact suppression portion, it is possible to suppress the jet water from contacting the air inside of the throat pipe. As a result, it is possible to make it difficult draw in the air inside of the throat pipe by suction even if the jet water is injected, and to suppress the noise generated by the suction of the air.

According to an eighth invention, the tank includes a water-surface-falling suppression portion suppressing a water surface in the tank from falling by the jet water at the time of supplying the water into the tank.

According to the conventional technique, the jet water draws in the surrounding water while traveling in the water stored in the tank at the time of supplying the water into the tank because of the high flow velocity, the water surface inside of the tank falls, and the jet water draws in the air present outside of the throat pipe by suction, possibly resulting in the generation of the noise.

In the flush toilet apparatus according to the preferred embodiment, by contrast, by providing the water-surface-falling suppression portion in the tank, it is possible to suppress the water surface from falling by the jet water traveling in the water inside of the tank. As a result, it is possible to make it difficult for the jet water to draw in the air outside of the throat pipe by suction and to suppress the noise generated by the suction of the air.

According to a ninth invention, the water-surface-falling suppression portion includes a tank-water-contact suppression portion suppressing the jet water from contacting the water present above the jet water inside of the tank at the time of supplying the water into the tank.

According to the conventional technique, the jet water draws in the water present above the jet water inside of the tank while traveling in the water stored in the tank at the time of supplying the water into the tank because of the high flow velocity, the water surface inside of the tank falls, possibly resulting in the generation of the noise.

In the preferred embodiment, by contrast, by providing the tank-water-contact suppression portion, it is possible to suppress the jet water from contacting the water present above the jet water inside of the tank. It is thereby possible to suppress the water surface above the jet water in the tank from falling. As a result, it is possible to make it difficult to draw in the air outside of the throat pipe by suction and to suppress the noise generated by the suction of the air.

According to a tenth invention, the water-surface-falling suppression portion includes an underwater mixing portion mixing the jet water underwater at the time of supplying the water into the tank.

By providing the underwater mixing portion that mixes the jet water underwater, the jet water loses a directivity when striking against the underwater mixing portion at the time of supplying the water into the tank. It is thereby possible to suppress the jet water from drawing in the water inside of the tank and the water surface in the tank from falling. As a result, it is possible to make it difficult to draw in the air outside of the throat pipe by suction and to suppress the noise generated by the suction of the air.

DETAILED DESCRIPTION OF THE PREFERRED EMBODIMENTS

Preferred embodiments of the present invention are described hereinafter with reference to the accompanying drawings. In all the drawings, like constituent elements are denoted by like reference symbols as much as possible and are not repeatedly described for facilitating understanding the description.

Figure 1:
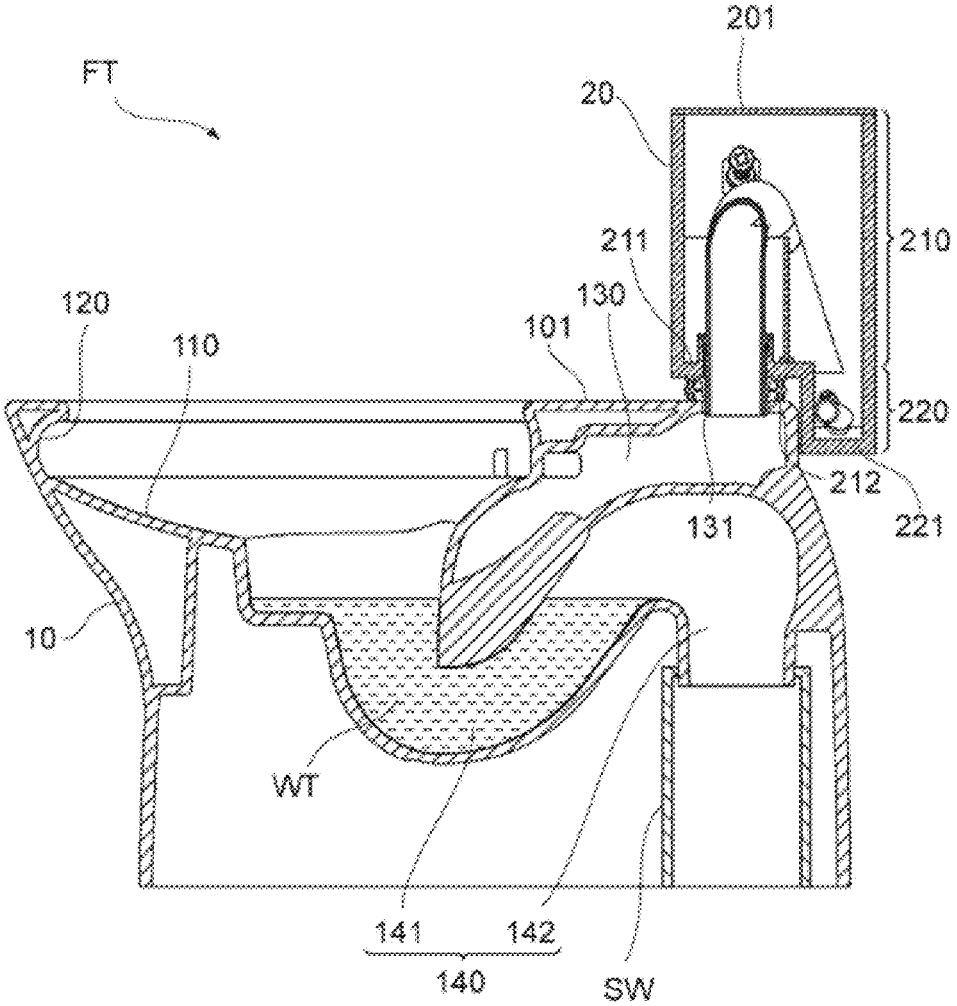
FIG. 1 is a cross-sectional view showing a flush toilet apparatus according to a first embodiment of the present invention.
Figure 2:
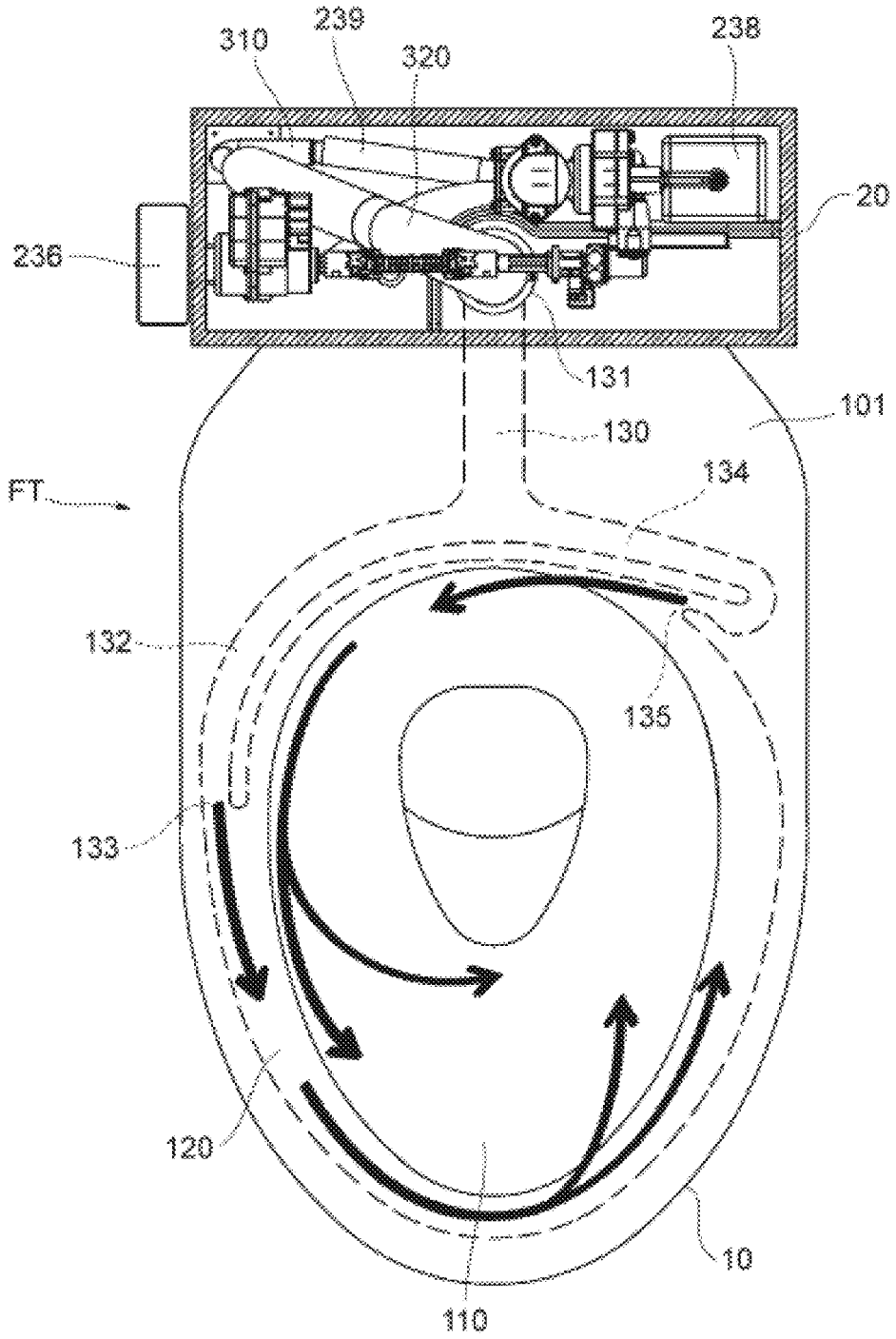
FIG. 2 is a top view of the flush toilet apparatus shown in FIG. 1.

A flush toilet apparatus according to a first embodiment of the present invention is described with reference to FIGS. 1 and 2. FIG. 1 is a cross-sectional view of a flush toilet apparatus FT and shows a cross-section taken along a plane perpendicular to a left-right direction of the flush toilet apparatus FT. FIG. 2 is a top view of the flush toilet apparatus FT. FIG. 2 depicts a state in which a top lid 201 of a tank 20 is detached for showing an internal structure of the tank 20 to be described later.

As shown in FIGS. 1 and 2, the flush toilet apparatus FT includes a toilet body 10, and the tank 20 provided on an upper surface 101 of the toilet body 10 backward of the toilet body 10 (on a right side in FIG. 1 and a top side in FIG. 2). The flush toilet apparatus FT is an apparatus that receives waste in the toilet body 10 and that discharges the waste to a drain pipe SW using water (wash water) supplied from the tank 20.

In the following description, a right side or right (left side or left in FIG. 2) from a point of view of a user seated on the toilet body 10 is referred to as "right side or right", and a left side or left (right side or right in FIG. 2) from the point of view of the user seated on the toilet body 10 is referred to as "left side or left" unless specified otherwise. A forward side or forward (left side or left in FIG. 1 and lower side in FIG. 2) from the point of view of the user seated on the toilet body 10 is referred to as "front side or front" or "forward side or forward", and a backward side or backward (right side or right in FIG. 1 and upper side in FIG. 2) from the point of view of the user seated on the toilet body 10 is referred to as "rear side or rear" or "backward side or backward".

The toilet body 10 includes a bowl portion 110, a rim portion 120, a water conduit 130, and a drain trap pipeline 140. The bowl portion 110 is a portion that temporarily receives the waste falling from above. The rim portion 120 is formed in an upper edge portion of the bowl portion 110 in the form obtained by retreating a portion of an inner side surface of the bowl portion 110 toward an outer circumference of the bowl portion 110. As described later, the rim portion 120 serves as a channel in which the water supplied toward the bowl portion 110 flows in a circulating fashion. The rim portion 120 is formed as a generally circular channel (in a view from the top) around an upper edge of the bowl portion 110.

The water conduit 130 is a channel formed inside of the toilet body 10 for introducing the water supplied from the tank 20 into the bowl portion 110. The water conduit 130 has one end that opens to the upper surface 101 of the toilet body 10, and the open end serves as an inlet 131 of the water supplied from the tank 20. A position at which the inlet 131 is formed corresponds to a backward portion of the upper surface 101 of the toilet body 10 and to a central portion in the left-right direction.

The water conduit 130 branches to two channels (a first water conduit 132 and a second water conduit 134) downstream of the water conduit 130. One of the branch channels, i.e., the first water conduit 132 has a downstream end portion that opens in a right portion of the rim portion 120, and the open end portion, i.e., opening serves as an outlet of the water (water outlet portion 133). If the water is supplied from the tank 20 to the inlet 131, a part of the water is passed through the first water conduit 132, injected from the water outlet portion 133, and supplied to the rim portion 120.

The other branch channel, i.e., the second water conduit 134 has a downstream end portion that opens in a left backward portion of the rim portion 120, and the open end portion, i.e., opening serves as an outlet of the water (water outlet portion 135). If the water is supplied from the tank 20 to the inlet 131, a part of the water is passed through the second water conduit 134, injected from the water outlet portion 135, and supplied to the rim portion 120.

A direction in which the water is injected from the water outlet portion 133 is a direction along a circumference of the rim portion 120 formed as a generally circular channel and also a counterclockwise direction in the view from the top. A direction in which the water is injected from the water outlet portion 135 is also a direction along a circumference of the rim portion 120 formed as a generally circular channel and also a counterclockwise direction in the view from the top. As indicated by arrows in FIG. 2, all the water injected from the water outlet portions 133 and 135 to the rim portion 120 flows downward from the entire rim portion 120 toward the bowl portion 110 while circulating and flowing along the rim portion 120 counterclockwise.

The drain trap pipeline 140 is a channel that connects a lower end of the bowl portion 110 to the drain pipe SW. The drain trap pipeline 140 includes a rising channel 141 formed to have a rising slope along a direction downstream from the lower end of the bowl portion 110, and a falling channel 142 formed to have a falling slope along a direction downstream from an upper end of the rising channel 141. By so configuring the drain trap pipeline 140, the water can be stored in a part from a lower portion of the bowl portion 110 to a lower portion of the rising channel 141, and the stored water forms sealing water WT. The drain pipe SW is connected to a lower end of the falling channel 142. The drain pipe SW is a pipe arranged inside of a building and a downstream end portion of the drain pipe SW is connected to a sewer (not shown).

When the water is supplied from the tank 20 toward the bowl portion 110, the water flows downward from the entire rim portion 120 toward the bowl portion 110 while circulating and flowing in the rim portion 120. The water is added from upward of the bowl portion 110 and discharged from the lower end portion of the bowl portion 110 through the rising channel 141 and the falling channel 142. As a result, a downward flow is generated in the water (sealing water WT) stored in the bowl portion 110.

The waste temporarily received by the bowl portion 110 is forced downward by the water supplied from the rim portion 120 above the bowl portion 110, and moved toward the lower end of the bowl portion 110. The waste subsequently reaches the falling channel 142 through the rising channel 141 by the water flow, and the waste as well as the water falls toward the drain pipe SW.

The tank 20 is a container in which the water is stored and provided to supply the water to the inlet 131 of the water conduit 130. The tank 20 includes a first tank portion 210 and a second tank portion 220 formed to extend downward a part of a bottom wall 211 of the first tank portion 210. Each of the first tank portion 210 and the second tank portion 220 is a generally rectangular parallelepiped container, and internal spaces of both the first tank portion 210 and the second tank portion 220 communicate with each other. The second tank portion 220 is connected to a backward portion of the bottom wall 211 of the first tank portion 210.

The bottom wall 211 of the first tank portion 210 (portion forward of the second tank portion 220) is in a state of being proximate to a backward portion of the upper surface 101 of the toilet body 10 from above. Specifically, while the inlet 131 is formed in the backward portion of the upper surface 101 of the toilet body 10, the bottom wall 211 of the first tank portion 210 is proximate from above to the upper surface 101 of the toilet body 10 so as to cover a periphery of the inlet 131 from above. Furthermore, an opening 212 generally identical in shape to the inlet 131 is formed in the bottom wall 211, and the opening 212 overlaps with the inlet 131 in the view from the top. Owing to this, the water stored in the tank 20 flows into the water conduit 130 via the opening 212 and the inlet 131 and can flow toward the bowl portion 110.

As a result of arranging the first tank portion 210 as described above, the second tank portion 220 is located backward of the toilet body 10. That is, the second tank portion 220 is located backward of a backward end portion of the toilet body 10. Moreover, a bottom wall 221 of the second tank portion 220 is arranged at a position lower than the upper surface 101 of the toilet body 10.

By arranging the tank 20 as described above, a front end portion of the tank 20 is located forward of a rear end portion of the toilet body 10. A lower end portion of the tank 20 is located downward of the upper surface 101 of the toilet body 10. As a result, dimensions of the entire flush toilet apparatus FT in a longitudinal direction and dimensions thereof in a vertical direction are both made smaller, thus improving the flush toilet apparatus FT in design.

Figure 3:
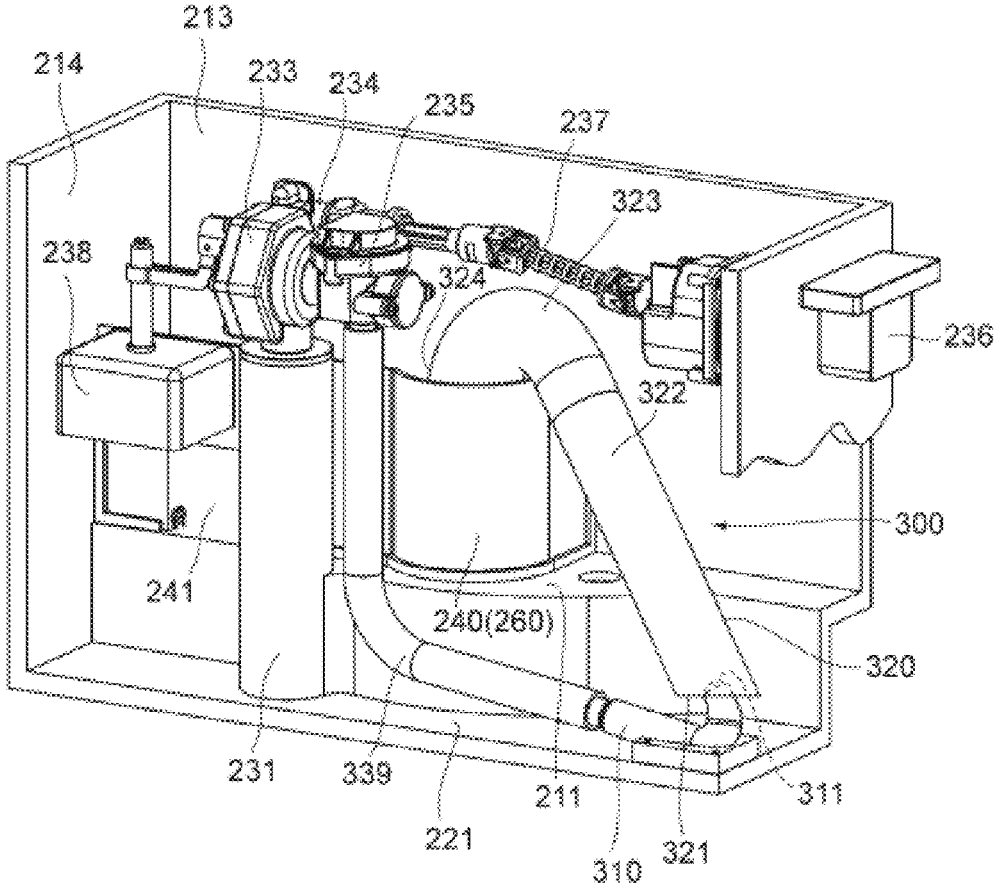
FIG. 3 is a perspective view showing an inside of a tank of the flush toilet apparatus shown in FIG. 1.

An internal configuration of the tank 20 is described. FIG. 3 is a perspective view showing an inside of the tank 20 in a view of the flush toilet apparatus FT from backward. As shown in FIG. 3, a water supply pipe 231, a main valve 233, a pilot valve 234, and a jet pump unit 300 are arranged inside of the tank 20.

The water supply pipe 231 is a pipe for supplying the water toward the main valve 233 and arranged to extend vertically upward from the bottom wall 221 of the second tank portion 220. A lower end of the water supply pipe 231 is connected to a water pipe (not shown) outside of the tank 20. An upper end of the water supply pipe 231 is connected to the main valve 233 inside of the tank 20 from below. The water supply pipe 231 is arranged at a position leftward of a horizontal center inside of the tank 20.

A constant flow valve 232 (not shown in FIG. 3) is arranged halfway along the water supply pipe 231 (between the water pipe and the main valve 233). The constant flow valve 232 sets a flow rate of the water flowing into the main valve 233 to be constant in a state in which the main valve 233 is open, and this flow rate does not change by a water pressure inside of the water pipe.

The main valve 233 is an open/close valve for opening/closing a channel of the water from the water supply pipe 231 toward the jet pump unit 300. A vacuum breaker 235 is provided between the main valve 233 and the jet pump unit 300, and prevents the water from flowing back if an upstream side of the vacuum breaker 235 has a negative pressure. As described above, the water supply pipe 231 extends upward and the main valve 233 and the vacuum breaker 235 are arranged at higher positions within the tank 20. This can prevent the vacuum breaker 235 from being submerged even in a state in which a water level of the tank 20 is equal to a full water level.

The main valve 233 includes the pilot valve 234 and the main valve 233 is configured to be open or closed in response to an action of the pilot valve 234. An operation lever 236 arranged outside of the tank 20 is connected to the pilot valve 234 via a transmission mechanism 237 arranged inside of the tank 20. A float member 238 arranged inside of the tank 20 is also connected to the pilot valve 234.

If a user of the flush toilet apparatus FT operates the operation lever 236, the operation is transmitted to the pilot valve 234 via the transmission mechanism 237 and the pilot valve 234 opens. This turns the main valve 233 into an open state, whereby the water flows from the water supply pipe 231 toward the jet pump unit 300. As described later, the water flowing toward the jet pump unit 300 together with the water stored inside of the tank 20 is supplied to the water conduit 130 as the wash water. For this reason, the water level inside of the tank 20 gradually lowers.

Even after washing of the bowl portion 110 is completed, the main valve 233 is not closed and the water continues to flow from the water supply pipe 231 toward the jet pump unit 300. The water flowing toward the jet pump unit 300 is supplied into the tank 20 and stored for next washing. As the water is supplied toward the inside of the tank 20 (poured into the tank 20), the water level inside of the tank 20 gradually rises. The float member 238 connected to the pilot valve 234 inside of the tank 20 rises as the water level rises, thereby closing the pilot valve 234.

In this way, if the water level rises inside of the tank 20, a change in the buoyant force acting on the float member 238 causes the pilot valve 234 to be closed. If the pilot valve 234 is closed, then the main valve 233 is in a closed state, and the supply of the water from the water supply pipe 231 to the jet pump unit 300 stops. The arrangement of the float member 238 is adjusted so that an amount of the water stored inside of the tank 20 at this time is equal to a necessary amount for the next washing (predetermined full water level).

The jet pump unit 300 is intended to trigger the jet pump action by the water supplied from the water supply pipe 231 to thereby supply the water toward the water conduit 130. The jet pump unit 300 includes a nozzle 310 and a throat pipe 320.

The nozzle 310 is a pipe having one end connected to the vacuum breaker 235 via a connection pipe 339 and the other end with an injection port 311 formed therein. The nozzle 310 is arranged near the bottom wall 221 of the second tank portion 220. When the main valve 233 opens, the water supplied from the water supply pipe 231 flows through the connection pipe 339, reaches the nozzle 310, and is injected as a high velocity water flow from the injection port 311. The nozzle 310 is arranged in a backward right corner (corner in the view from the top) of the second tank portion 220. As shown in FIG. 3, the nozzle 310 is U-shaped and a downstream side of the nozzle 310 is folded back in the corner. The injection port 311 is directed toward an inside of the throat pipe 320.

The throat pipe 320 is a pipe having a circular cross-section, and arranged inside of the tank 20 in a state in which a part of the throat pipe 320 penetrates the opening 212 formed in the bottom wall 211. One end of the throat pipe 320 is connected to the inlet 131 of the water conduit 130 and a suction port 321 that is an opening is formed in the other end thereof. A part of the throat pipe 320 near the inlet 131 of the water conduit 130 is along the vertical direction, and a part thereof near the suction port 321 is inclined with respect to a horizontal plane. Owing to this, the throat pipe 320 is inverted U-shaped as a whole. As shown in FIG. 2, the throat pipe 320 is arranged inside of the tank 20 in a state of being inclined with respect to the longitudinal direction in the view from the top.

The specific shape of the throat pipe 320 is described in more detail. The throat pipe 320 includes a rising portion 322 extending obliquely upward from the suction port 321, a curved portion 323 arranged downstream (upward) of the rising portion 322, and a falling portion 324 arranged downstream (downward) of the curved portion 323 and extending downward from the curved portion 323.

The rising portion 322 is a cylindrical pipe having a uniform pipe diameter throughout a pipe shape, and arranged in an inclined state with respect to the horizontal plane. The suction port 321 is formed in a lower end of the rising portion 322. The suction port 321 is formed so that an entire edge of the suction port 321 is along the horizontal plane (parallel to the horizontal plane).

The falling portion 324 is a cylindrical pipe having a uniform pipe diameter throughout a pipe shape. The falling portion 324 is larger in pipe diameter than the rising portion 322. A pipe diameter of the curved portion 323 near the rising portion 322 is equal to that of the rising portion 322. A pipe diameter of the curved portion 323 near the falling portion 324 is equal to that of the falling portion 324. Therefore, it can be paraphrased that the curved portion 323 smoothly couples the rising portion 322 and the falling portion 324 having the different pipe diameters.

Figure 4A:
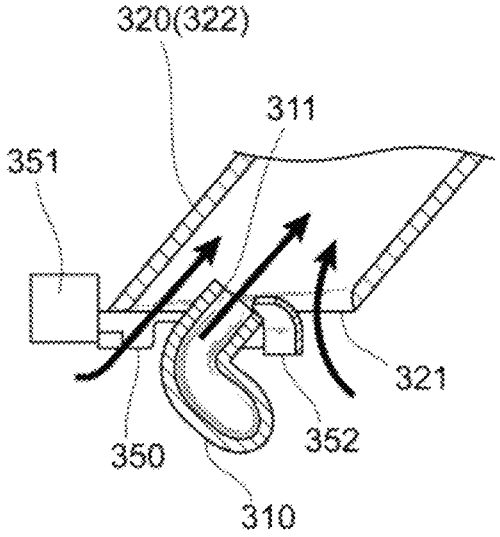
FIG. 4A is a schematic diagram showing a state in which jet water is injected from a nozzle when a water level inside of the tank is higher than a suction port (equal to a full water level, for example), and in which a jet pump action is thereby triggered.

A configuration and operations of the jet pump unit 300 are further described with reference to FIGS. 4A and 4B. FIG. 4A is a schematic diagram showing a state in which the jet water is injected from the nozzle 310 when the water level inside of the tank 20 is higher than the suction port 321 (equal to the full water level, for example), and in which the jet pump action is thereby triggered.

If the main valve 233 is opened and the jet water is injected from the injection port 311 of the nozzle 310, the jet water flows toward an inside of the rising portion 322. A lower side portion of the rising portion 322 and the nozzle 310 are submerged in the water stored in the tank 20. Owing to this, the water stored in the tank 20 is drawn inside of the rising portion 322 by the jet water injected from the injection port 311 and flows toward the water conduit 130. As a result of triggering such a jet pump action, not only the jet water injected from the injection port 311 of the nozzle 310 but also the water drawn in from a circumference of the suction port 321 flows inside of the throat pipe 320. The water flows through the water conduit 130 and is supplied to the rim portion 120 from the water outlet portions 133 and 135 as the wash water.

In this way, in the flush toilet apparatus FT, the water supplied to the rim portion 120 is higher in flow rate than the jet water injected from the injection port 311 of the nozzle 310. In other words, even if the flow rate of the jet water injected from the injection port 311 of the nozzle 310 is low, the water is supplied to the rim portion 120 by a flow rate sufficient as that of the wash water. Owing to this, even if the flush toilet apparatus FT is installed in an environment in which the pressure of the water pipe is low, the flush toilet apparatus FT is able to exhibit a sufficient washing performance.

Furthermore, a total amount of the water supplied to the rim portion 120 (and the bowl portion 110) as the wash water is a sum of an amount of the water stored inside of the tank 20 in advance and that of the jet water injected from the injection port 311 of the nozzle 310. The tank 20 is made smaller in size and improved in design because of no need to store all the wash water inside of the tank 20.

Meanwhile, the water present in portions below the suction port 321 in the tank 20 is not supplied into the throat pipe 320 from the suction port 321. As a result, the water remains inside of the tank 20 as residual water. However, as shown in FIG. 3 and the like, both the nozzle 310 and the suction port 321 are arranged inside of the (narrow) second tank portion 220. Owing to this, the residual water remaining in the portions below the suction port 321 is relatively small in amount.

With such a configuration, in the flush toilet apparatus FT, the amount of the residual water is made smaller at a time of finishing the supply of the water to the rim portion 120. As a result, a majority of an internal space of the tank 20 can be used as a space for storing the water to be supplied to the rim portion 120 (water that does not remain as the residual water). This can suppress the tank 20 from being made larger in size.

A traveling-direction switching mechanism 350 is attached to the neighborhood of the lower end of the rising portion 322, i.e., to the neighborhood of the suction port 321. The traveling-direction switching mechanism 350, which is a rod member, includes a float member 351 on one end along a longitudinal direction of the traveling-direction switching mechanism 350 and a shield portion 352 on the other end thereof. Note that the traveling-direction switching mechanism 350 is not shown in FIG. 3 and the like previously referred to.

A portion between the float member 351 and the shield portion 352 of the traveling-direction switching mechanism 350 is rotatably attached to the neighborhood of the lower end of the rising portion 322. As shown in FIG. 4A, when the water level inside of the tank 20 is higher than the suction port 321, the buoyant force acting on the float member 351 rotates the traveling-direction switching mechanism 350. Specifically, the float member 351 moves upward, the shield portion 352 moves downward, and the float member 351 and the shield portion 352 stop at positions shown in FIG. 4A, respectively.

In a state of FIG. 4A, the jet water injected from the nozzle 310 flows into the rising portion 322 without directly striking against the shield portion 352. As a result, the jet pump action already described above is triggered, thereby supplying the water as the wash water to the rim portion 120.

The water level inside of the tank 20 gradually lowers by subsequently supplying the water inside of the tank 20 to the rim portion 120.

Figure 4B:
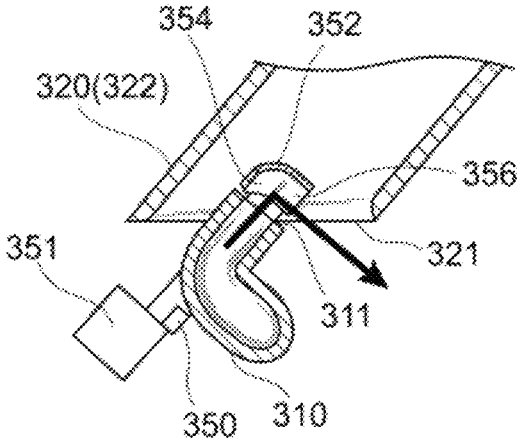
FIG. 4B is a schematic diagram showing a state in which the water level inside of the tank lowers to the neighborhood of the suction port, and in which the supply of water to a rim portion stops.

FIG. 4B is a schematic diagram showing a state in which the water level inside of the tank 20 lowers to the neighborhood of the suction port 321, and in which the supply of water to the rim portion 120 stops. When the water level inside of the tank 20 lowers to the neighborhood of the suction port 321, the buoyant force acting on the float member 351 is weakened. Owing to this, as shown in FIG. 4B, the traveling-direction switching mechanism 350 rotates to move the float member 351 downward. The shield portion 352 moves upward, so that all the jet water injected from the nozzle 310 directly strikes against the shield portion 352.

A guide surface 355 of the shield portion 352 that faces the injection port 311 is formed into a concave curve shape. This guide surface 355 faces the entire injection port 311 and is arranged to be able to switch the traveling direction of almost all the jet water. One end 354 of the guide surface 355 which faces the injection port 311 and has the concave curve shape is generally in parallel to an inner wall of the injection port 311 and the other end 356 thereof is generally in parallel to the injection port 311 and oriented obliquely downward of the tank 20. If the jet water injected from the nozzle 310 strikes against the guide surface 355, then the jet water flows along the guide surface 355, the traveling direction of the jet water changes by about 90 degrees, and the jet water is directed downward inside of the tank 20 with the flow of the jet water kept uniform (without disturbing the flow of the jet water). As a result, the jet water injected from the nozzle 310 does not flow into the rising portion 322 but is stored in the tank 20 as the water for the next washing. As can be seen, the traveling-direction switching mechanism 350 is a mechanism for switching the supply destination of the jet water injected from the nozzle 310 from the toilet body 10 to the tank 20.

A time of (the middle of) the supply of the jet water injected from the nozzle 310 into the tank 20 by the traveling-direction switching mechanism 350 is referred to as "tank supply time", hereinafter.

To switch the traveling direction of the jet water without disturbing the flow of the jet water during the tank supply time (including a time right after switching the traveling direction), the traveling-direction switching mechanism 350 is configured as follows. If attention is paid only to a configuration of the shield portion 352, for example, the shield portion 352 is configured, for example, so that the guide surface 355, which faces the injection port 311, of the shield portion 352 is formed into a concave curve shape, and so that the shield portion 352 faces the entire injection port 311, as described above. Furthermore, to orient the traveling direction of the jet water downward inside of the tank 20, the traveling-direction switching mechanism 350 is configured, for example, so that one end 354 of the shield portion 352 which faces the injection port 311 and has the concave curve shape is generally in parallel to the inner wall of the injection port 311, and so that the other end 356 of the opposing surface is generally in parallel to the injection port 311 and oriented obliquely downward of the tank 20.

Figure 5:
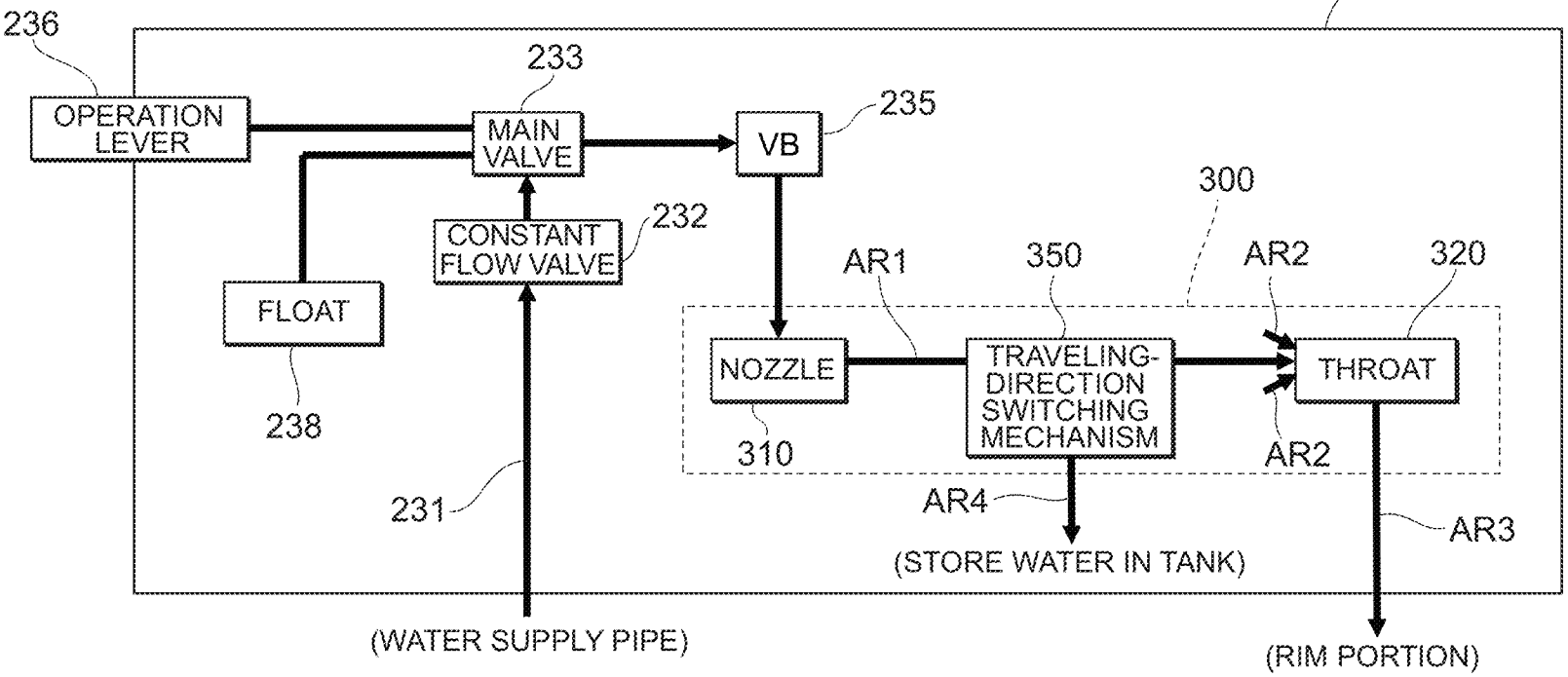
FIG. 5 is an explanatory diagram of operations of a jet pump unit arranged inside of the tank shown in FIG. 3.

FIG. 5 is a schematic diagram showing the internal configuration of the tank 20. As already described, the water supply pipe 231, the main valve 233, and the jet pump unit 300 are arranged inside of the tank 20.

In a state (standby state) in which the bowl portion 110 is not washed, the water level of the tank 20 is equal to the full water level. If the user of the flush toilet apparatus FT operates the operation lever 236, then the main valve 233 is in the open state, and the water is injected from the injection port 311 of the nozzle 310 (arrow AR1 in FIG. 5), as already described. The water stored inside of the tank 20 is drawn into the throat pipe 320 (arrow AR2 in FIG. 5) and supplied to the rim portion 120 as the wash water (arrow AR3 in FIG. 5).

After the end of the supply of the water to the rim portion 120, the traveling-direction switching mechanism 350 switches the supply destination of the water from the nozzle 310, thereby starting pouring (supplying) the water into the tank 20 (arrow A4 in FIG. 5). The water level inside of the tank 20 gradually rises, and the float member 238 closes the pilot valve 234 at a time of the full water level. Simultaneously with the closing of the pilot valve 234, the main valve 233 is closed, thereby finishing pouring the water into the tank 20 and returning the state of the flush toilet apparatus FT to the standby state.

Referring again to FIG. 3, the other internal configuration of the tank 20 is described. As shown in FIG. 3, a partition wall 240 is arranged to surround the falling portion 324 of the throat pipe 320 inside of the tank 20. The partition wall 240 is formed to extend upward from the bottom wall 211. The partition wall 240, a front wall surface 213 and a left wall surface 214 of the tank 20, and the bottom wall 211 of the first tank portion 210 define a part of the internal space of the tank 20 and constitute a small tank 260. The small tank 260 is a container having an upper portion that opens to the inside of the tank 20, and arranged in a forward left corner of the first tank portion 210. The lower end portion of the falling portion 324 of the throat pipe 320 is arranged inside of the small tank 260. The suction port 321 is arranged outside of the small tank 260.

An open/close window 241 is provided in the neighborhood of a lower end portion of the partition wall 240. The open/close window 241 is normally open and the inside and an outside (a space backward of the partition wall 240) of the small tank 260 communicate with each other via the open/close window 241. Owing to this, in the state (standby state) in which the bowl portion 110 is not washed, the water level of the water stored in the tank 20 is equal to that of the water stored in the small tank 260.

The operation lever 236 is operable in two directions (a large direction and a small direction). If the operation lever 236 is operated in the large direction, the pilot valve 234 and the main valve 233 are opened in a state in which the open/close window 241 is open. The water stored in the small tank 260 passes through the open/close window 241, flows out to the second tank portion 220, and reaches the suction port 321. Owing to this, most of the water stored in the tank 20, including the water stored in the small tank 260, is drawn into the throat pipe 320 and supplied to the rim portion 120.

On the other hand, if the operation lever 236 is operated in the small direction, the pilot valve 234 and the main valve 233 are opened simultaneously with the closing of the open/close window 241. Owing to this, the water stored in the small tank 260 among that stored in the tank 20 is unable to pass through the open/close window 241 and remains inside of the small tank 260. As a result, the amount of water supplied to the rim portion 120 as the wash water becomes small.

In the following description, the reference to the "water level of the water stored in the tank 20", "the water level inside of the tank 20" or the like indicates the water level outside of the small tank 260. That is, the reference indicates the water level of the water stored in a space in which the suction port 321 is arranged out of two spaces divided by the partition wall 240. The water level of the water stored in the small tank 260 is not considered in the following description.

Figure 6:
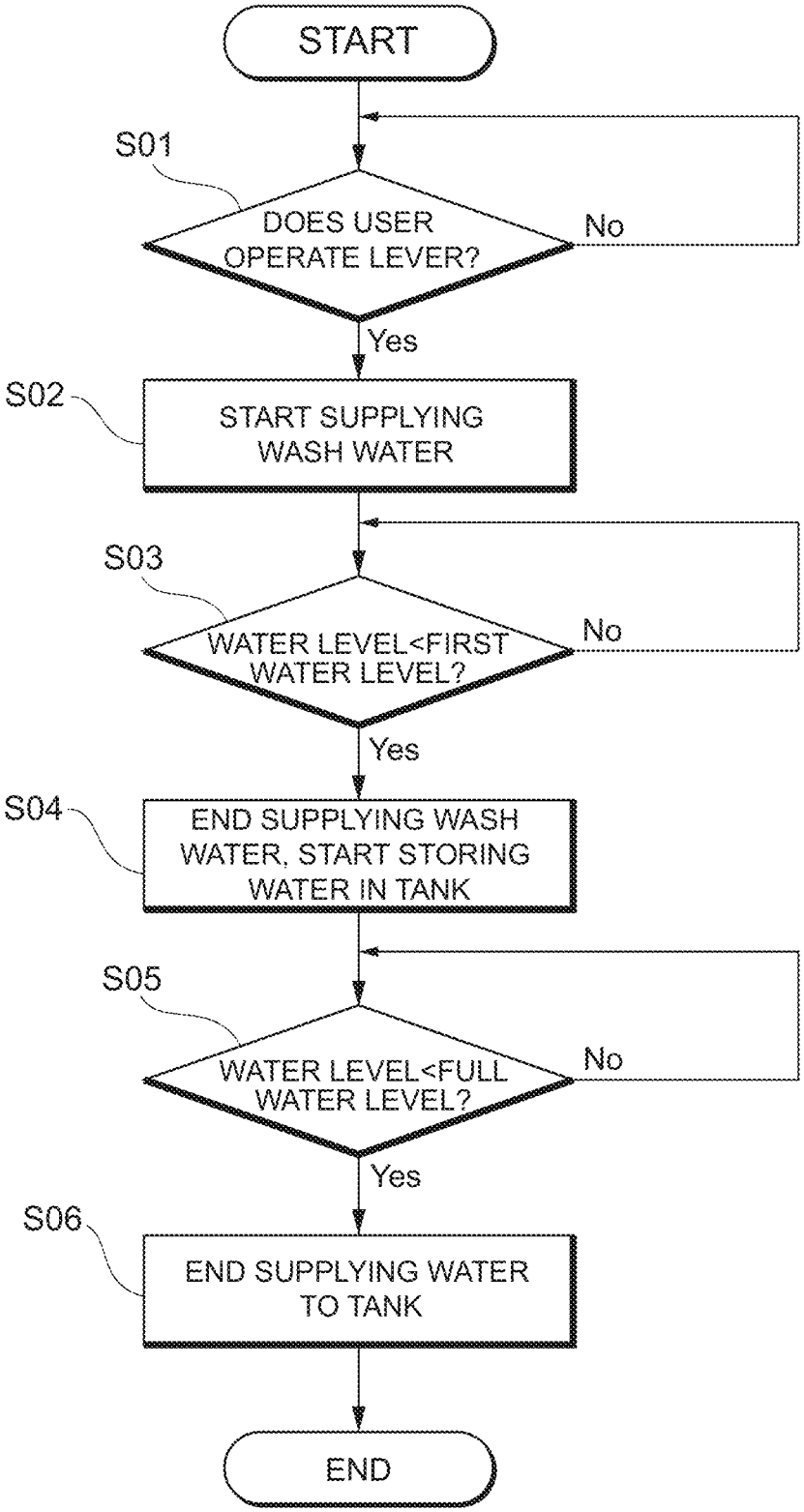
FIG. 6 is a flowchart showing a flow of operations of the flush toilet apparatus shown in FIG. 1 at a time of washing.

Next, the flow rate of the water supplied to the rim portion 120 as the wash water (which may be restated as the flow rate of the water supplied to the water outlet portions 133 and 135) is described with reference to FIG. 6. FIG. 6 is a flowchart of the flow of operations of the flush toilet apparatus FT at a time of washing.

First, when the user of the flush toilet apparatus FT operates the operation lever 236 (Step S01), the water is injected from the nozzle 310 and, as already described, supplied to the rim portion 120 by the jet pump action (Step S02).

During a period since the injection of the water from the nozzle 310 starts until the water level inside of the tank 20 lowers to a position (hereinafter, also referred to as "first water level") at which the traveling-direction switching mechanism 350 switches the traveling direction of the injected water, a large amount of water is supplied to the rim portion 120 by the jet pump action (Step S03).

When the water level inside of the tank 20 lowers to the first water level, the water continuously injected from the nozzle 310 is stored in the tank 20 (Step S04). When the water level inside of the tank 20 rises to be equal to the full water level, the injection of the water from the nozzle 310 is stopped and the storage of the water in the tank 20 is stopped (Steps S05 and S06).

Figure 7A:
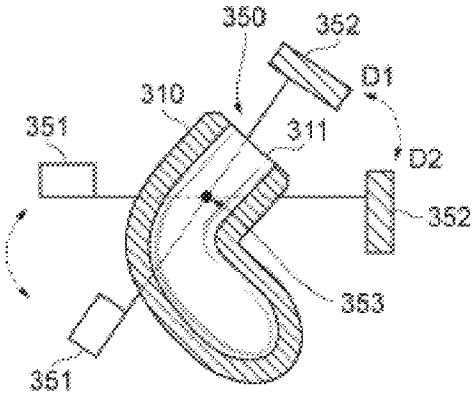
FIGS. 7A to 7D are side views showing movements and positions of a shield portion included in a traveling-direction switching mechanism.
Figure 7B:
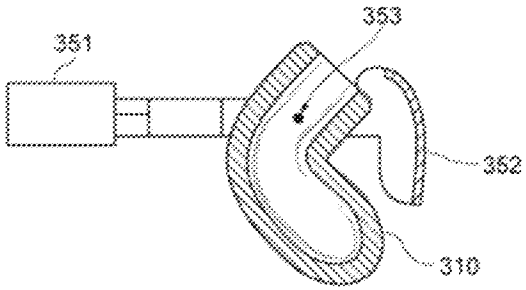
Figure 7C:
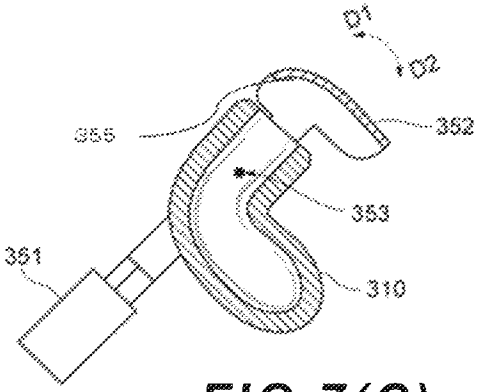
Figure 7D:
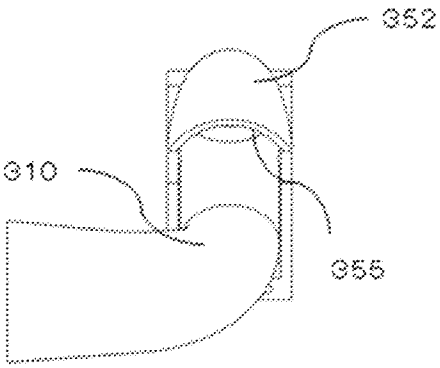

FIGS. 7A to 7D are side views showing the traveling-direction switching mechanism 350 and the shield portion 352 included in the traveling-direction switching mechanism 350. FIG. 7A shows an exemplary movement of the traveling-direction switching mechanism 350. FIG. 7B shows the traveling-direction switching mechanism 350 in a toilet washing mode in which the supply destination of the jet water injected from the nozzle 310 is the inside of the throat pipe 320. FIG. 7C shows the traveling-direction switching mechanism 350 in a tank storage mode in which the supply destination of the jet water injected from the nozzle 310 is the outside of the throat pipe 320. FIG. 7D is a right side view of the traveling-direction switching mechanism 350 in the toilet washing mode.

As shown in FIG. 7A, the traveling-direction switching mechanism 350 includes a moving mechanism 353 that moves the shield portion 352 that switches the traveling direction of the jet water between a position corresponding to the toilet washing mode and a position corresponding to the tank storage mode. That is, the moving mechanism 353 moves the shield portion 352 between a first direction D1 and a second direction D2 opposite to the first direction D1 during a mode transition between the tank storage mode and the toilet washing mode.

FIG. 7B shows the traveling-direction switching mechanism 350 in the toilet washing mode. In the toilet washing mode, the shield portion 352 is arranged at the position at which the shield portion 352 moves by a maximum amount to the second direction D2. Preferably, at the position of the shield portion 352 in the toilet washing mode, the shield portion 352 does not interfere with the jet water injected from the nozzle 310.

FIG. 7C shows the traveling-direction switching mechanism 350 in the tank storage mode. In the tank storage mode, the shield portion 352 is arranged at a second position at which the shield portion 352 moves by a maximum amount to the first direction D1.

As shown in FIG. 7C, the shield portion 352 includes the guide surface 355 configured to direct the water injected from the nozzle 310 to the second direction D2 at the time of switching the toilet washing mode to the tank storage mode. The shield portion 352 of the traveling-direction switching mechanism 350 shields the jet water so as to prevent the jet water injected from the nozzle 310 from flowing into the throat pipe 320. The traveling direction of the water injected from the nozzle 310 is oriented to the outside of the throat pipe 320 along this guide surface 355.

As shown in FIG. 7C, the guide surface 355 is provided in a first-direction-D1-side end portion of the shield portion 352 so that more jet water travels in the second direction D2 than the first direction D1 at the time of switching the traveling direction of the jet water.

Furthermore, as shown in FIG. 7C, the guide surface 355 is curved so as to prevent the jet water from striking against the guide surface 355 and the flow velocity of the jet water from thereby decelerating at the time of switching the traveling direction of the jet water.

FIG. 7D is the right side view of the traveling-direction switching mechanism 350 in the tank storage mode. As shown in FIG. 7D, the guide surface 355 of the shield portion 352 is formed into the concave shape so as to prevent the jet water from striking against the guide surface 355 and diffusing at the time of switching the traveling direction of the jet water. While the jet water is supposed to diffuse by striking against the guide surface 355, it is possible to suppress the diffusion of the jet water by forming the guide surface 355 into a concave shape. The concave shape may include a smooth curve shape.

While FIGS. 7A to 7D show examples in which the moving mechanism 353 rotates the shield portion 352 of the traveling-direction switching mechanism 350, it suffices that the moving mechanism 353 moves the shield portion 352. The moving mechanism 353 configured to rotate the shield portion 352 can be alternatively configured to linearly slide the shield portion 352.

The traveling-direction switching mechanism 350 shown in FIGS. 7A to 7D includes the float member 351 that switches the traveling direction of the jet water in a manner cooperative with the water level inside of the tank 20. Because of the provision of such a float member 351, the shield portion 352 can be moved in a manner cooperative with the water level inside of the tank 20. Nevertheless, the use of the float member 351 for moving the shield portion 352 is given only for illustrative purposes and it suffices to move the shield portion 352. Therefore, a moving mechanism 353 that moves the shield portion 352 electrically may be used.

Figure 8:
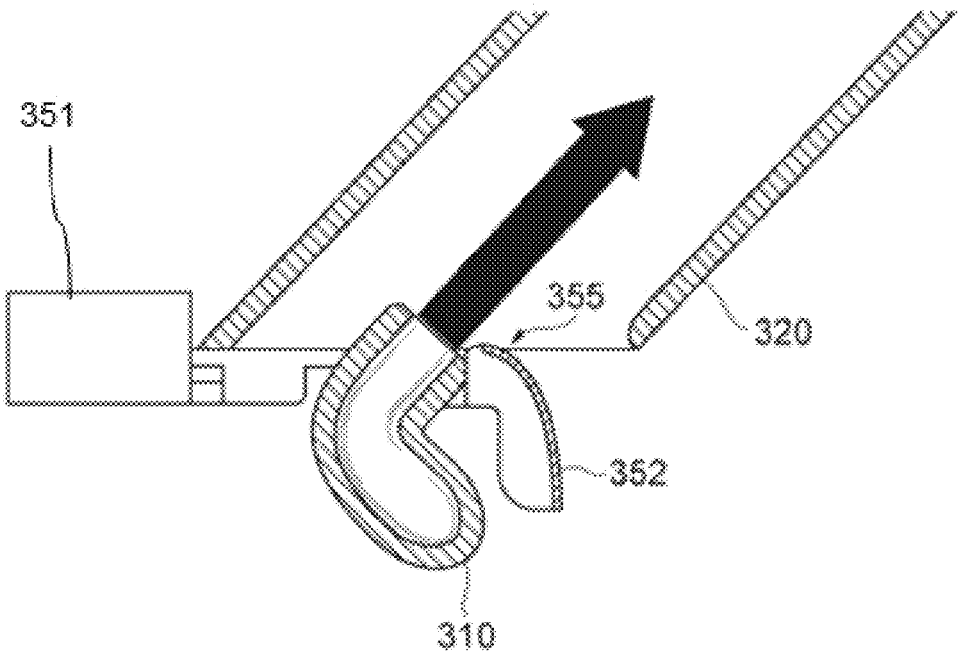
FIG. 8 is a diagram showing the position of the shield portion in a toilet washing mode.

Referring to FIGS. 8 to 10, the position of the shield portion 352 and the force acting on the shield portion 352 at the time of switching the toilet washing mode to the tank storage mode are described. FIG. 8 shows the position of the shield portion 352 in the toilet washing mode. As shown in FIG. 8, the jet water injected from the nozzle 310 is directed to the inside of the throat pipe 320 in the toilet washing mode. The shield portion 352 in the toilet washing mode is arranged at the position at which the shield portion 352 does not interfere with the jet water directed to the inside of the throat pipe 320.

Figure 9A:
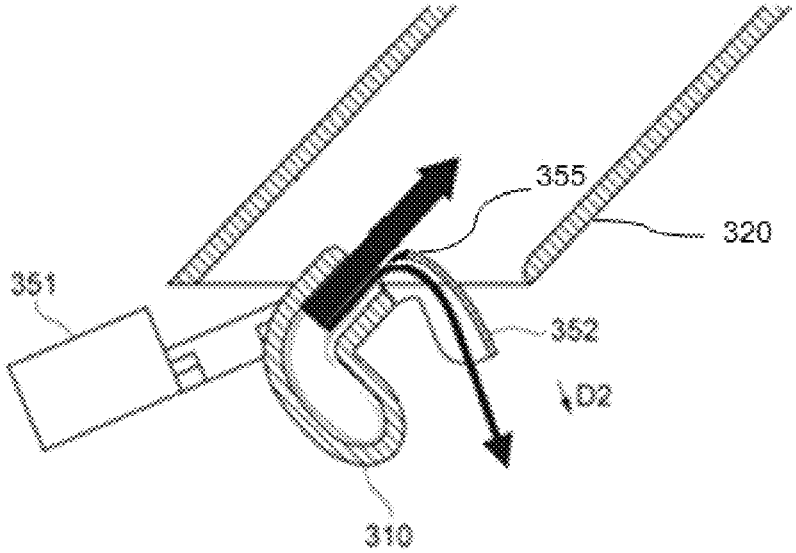
FIGS. 9A and 9B are explanatory diagrams of the positions of the shield portion during the transition from the toilet washing mode to the tank storage mode and a force that the jet water acts on the shield portion.
Figure 9B:
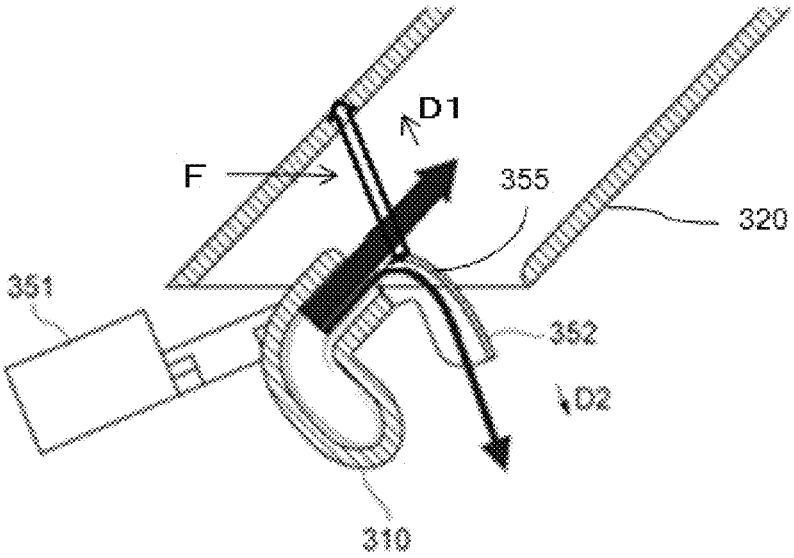

FIGS. 9A and 9B are explanatory diagrams of the position of the shield portion 352 during the mode transition from the toilet washing mode to the tank storage mode and the force on the shield portion 352 applied by the jet water the traveling direction of which is switched.

FIG. 9A shows the positions of the shield portion 352 and the guide surface 355 during the mode transition from the toilet washing mode to the tank storage mode. The guide surface 355 of the shield portion 352 interferes with the jet water, whereby the jet water is divided into the jet water in the direction of the inside of the throat pipe 320 and the jet water in the second direction D2 along the guide surface 355. Since the jet water guided to the second direction D2 by the guide surface 355 is directed to the outside of the throat pipe 320, the water level of the tank 20 (see FIG. 1) rises. As shown in FIGS. 7C and 7D, the guide surface 355 is formed to be provided in the first-direction-D1-side end portion of the shield portion 352. Furthermore, the guide surface 355 is formed into a concave shape to prevent the jet water, the traveling direction of which is switched, from striking against the guide surface 355 and diffusing. Moreover, the guide surface 355 is formed into a curve shape to suppress deceleration due to the switching of the traveling direction of the jet water.

FIG. 9B shows the force acting on the shield portion 352 during the mode transition from the toilet washing mode to the tank storage mode. As shown in FIG. 9B, a reactive force of the jet water directed to the outside of the throat pipe 320, i.e., to the second direction D2 causes a force F in the first direction D1 that is the direction corresponding to the switching to the tank storage mode to act on the shield portion 352. The amount of the jet water directed to the second direction D2 becomes larger and the force F becomes higher as the shield portion 352 moves farther to the first direction D1 corresponding to the switching to the tank storage mode.

The shield portion 352 receives the force F in the first direction D1 corresponding to the switching to the tank storage mode using the reactive force of the jet water directed to the second direction D2. It is thereby possible to instantaneously switch the toilet washing mode to the tank storage mode. By instantaneously switching the toilet washing mode to the tank storage mode, the total flow rate of the water used for washing can be reduced since the time for supplying the water the flow rate of which decreases by the interference of a part of the jet water with the shield portion 352 to the toilet body 10 can be reduced.

The guide surface 355 is formed to be provided in the first-direction-D1-side end portion of the shield portion 352. By switching the traveling direction of almost all the jet water to the second direction D2, it is possible to increase the force F in the first direction D1 acting on the shield portion 352. It is thereby possible to instantaneously switch the toilet washing mode to the tank storage mode.

The guide surface 355 is formed into a concave shape so as to prevent the jet water, the traveling direction of which is switched, from striking against the guide surface 355 and diffusing. The diffusion of the jet water is suppressed after the traveling direction is switched, whereby it is possible for the guide surface 355 to guide more jet water to the second direction D2. Therefore, the force F in the first direction D1 that the jet water acts on the shield portion 352 increases, thereby making it possible to instantaneously switch the toilet washing mode to the tank storage mode.

The guide surface 355 is formed into the curve shape so as to suppress the deceleration resulting from the switching of the traveling direction of the jet water. By suppressing the deceleration of the jet water resulting from the switching of the traveling direction of the jet water, it is possible to maintain a state in which the jet water travels at the high flow velocity. Therefore, the higher force F in the first direction D1 acts on the shield portion 352, thereby making it possible to instantaneously switch the toilet washing mode to the tank storage mode.

Figure 10A:
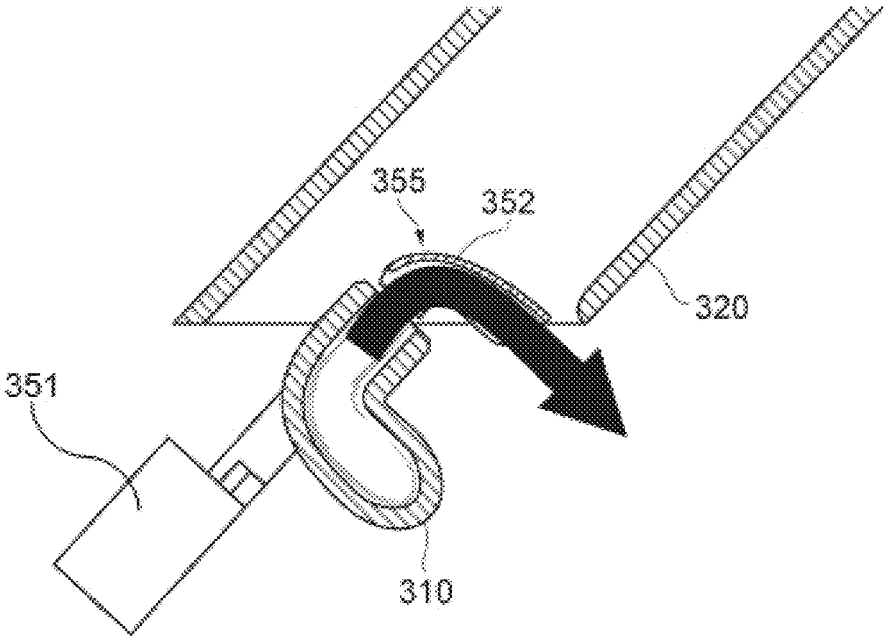
FIGS. 10A and 10B are schematic diagrams showing the positions of the shield portion in the tank storage mode.
Figure 10B:
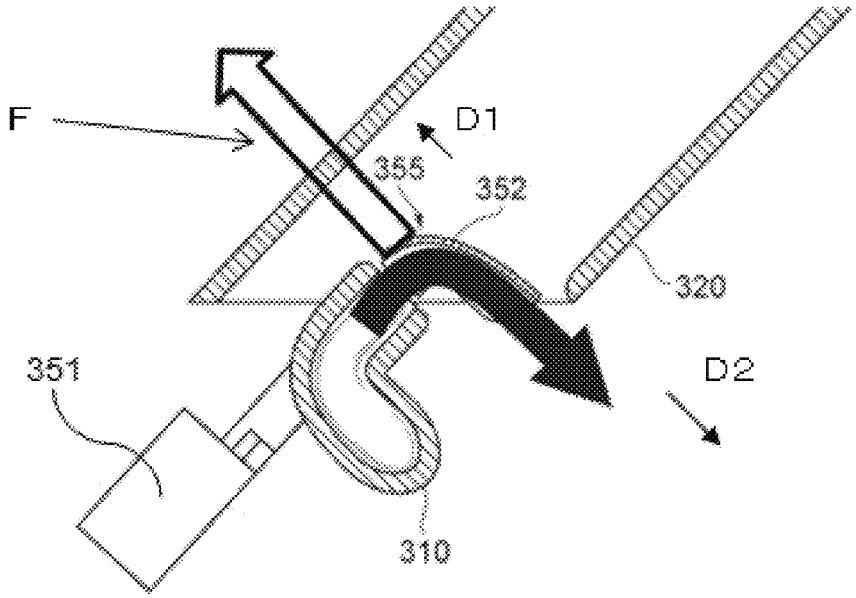

FIGS. 10A and 10B show the positions of the shield portion 352 and the guide surface 355 in the tank storage mode. FIG. 10A shows the position of the shield portion 352 in the tank storage mode. As shown in FIG. 10A, the shield portion 352 is arranged at the position at which the jet water is directed to the outside of the throat pipe 320, that is, in the second direction D2. That is, the shield portion 352 is at the position at which the shield portion 352 moves to the first direction D1 by the maximum amount. The jet water the traveling direction of which is switched by the shield portion 352 and the guide surface 355 is supplied to the tank 20, so that the water level inside of the tank 20 rises.

FIG. 10B shows the force acting on the shield portion 352 in the tank storage mode. As shown in FIG. 10B, the tank storage mode corresponds to a state in which the traveling direction of almost all the jet water is switched to the second direction D2 by the shield portion 352 and the guide surface 355. The jet water traveling in the second direction D2 causes the force F that is the reactive force of the jet water to act on the shield portion 352. This force F enables the shield portion 352 moved by the maximum amount to keep the position corresponding to the tank storage mode.

The flush toilet apparatus FT according to a second embodiment of the present invention is described. The flush toilet apparatus FT according to the second embodiment of the present invention is similar in configuration to that according to the first embodiment.

The flow of the jet water and the water level of the water supplied into the tank 20 at the time of washing in the second embodiment of the present invention are described with reference to FIGS. 6 and 11.

Figure 11:
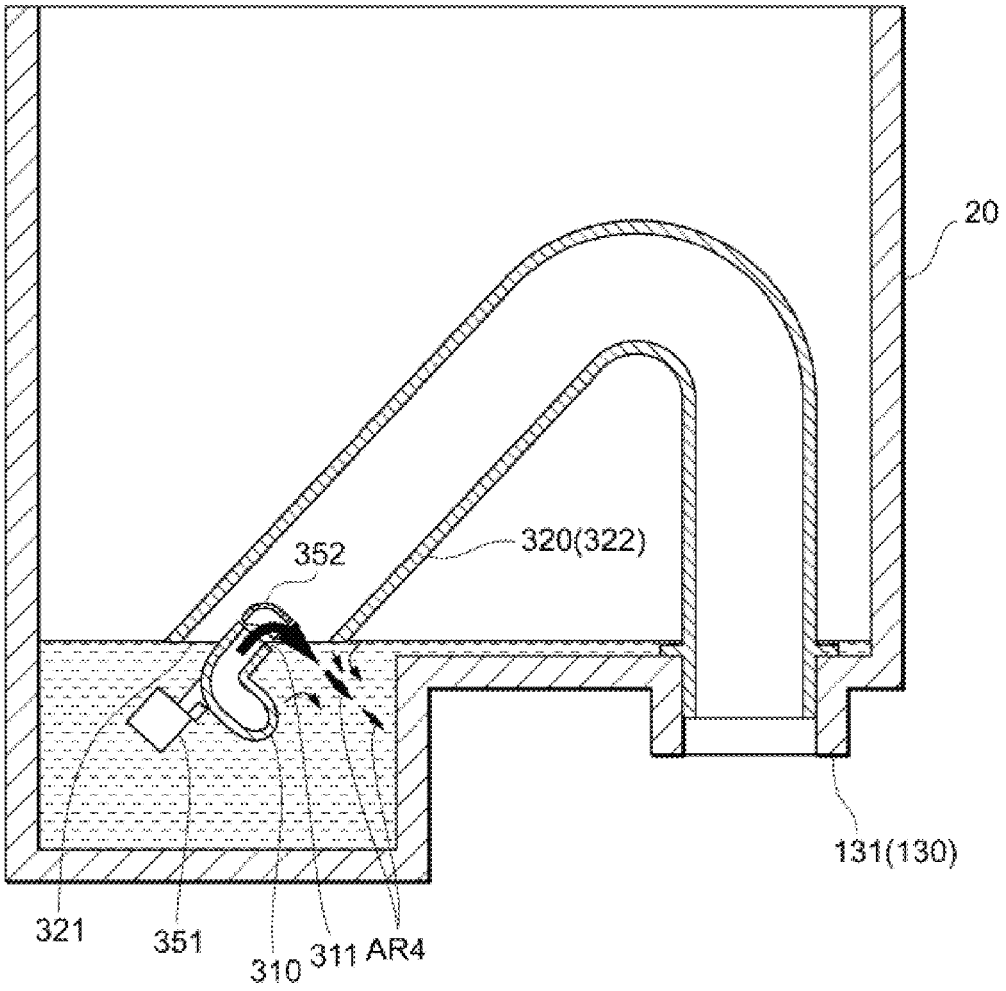
FIG. 11 is a schematic diagram showing a state in the tank at a time of supplying the water into the tank right after the traveling-direction switching mechanism switches a jet-water supply destination from a toilet body to the tank.

FIG. 11 is a schematic diagram showing a state in the tank 20 at a time of supplying the water into the tank 20 right after the traveling-direction switching mechanism 350 switches the jet-water supply destination from the toilet body 10 to the tank 20 in the flush toilet apparatus FT according to the second embodiment of the present invention.

First, when the user of the flush toilet apparatus FT operates the operation lever 236 (Step S01), the jet water is injected from the nozzle 310 and, as already described, supplied to the toilet body 10 through the water conduit 130 by the jet pump action (Step S02).

The supply of the water to the toilet body 10 continues until the water level inside of the tank 20 lowers and the traveling-direction switching mechanism 350 turns into the state shown in FIG. 4B. In other words, if the water is continuously supplied to the rim portion 120 and the water level inside of the tank 20 lowers to a preset water level, i.e., a zero water level, the supply of the water ends (Steps S03 and S04). The "zero water level" means a water level inside of the tank 20 at a time of the state shown in FIG. 4B after the buoyant force acting on the float member 351 of the traveling-direction switching mechanism 350 decreases and the traveling-direction switching mechanism 350 rotates. That is, the "zero water level" means the water level inside of the tank 20 at the time of stopping the supply of the wash water to the rim portion 120.

When the traveling-direction switching mechanism 350 rotates and turns into the state shown in FIG. 4B, the traveling direction of the jet water continuously injected from the nozzle 310 is switched to the outside of the throat pipe 320 and the water is supplied into the tank 20, as already described (Step S04). At the time of supplying the water into the tank 20, the water level inside of the tank 20 linearly and continuously rises with the passage of time. When the water level inside of the tank 20 continuously rises to be equal to the full water level, the injection of the jet water from the nozzle 310 is stopped and the supply of the water into the tank 20 is stopped (Steps S05 and S06). As a result, the buoyant force that the water stored in the tank 20 acts on the float member 351 rotates the traveling-direction switching mechanism 350 and the traveling-direction switching mechanism 350 returns to the original state shown in FIG. 4A. Note that a surface of the shield portion 352 continues to receive the force of the jet water and prevents the rotation caused by the buoyant force while the jet water continues to flow.

At such a time of supplying the water into the tank 20, the traveling-direction switching mechanism 350 orients the traveling direction of the jet water downward inside of the tank 20 without disturbing the flow of the jet water (arrow AR4 in FIG. 11) as shown in FIG. 11. Therefore, even if the jet water flows at the high flow velocity, the flow of the jet water is not greatly disturbed at the time of switching the traveling direction of the jet water. As a result, the flush toilet apparatus FT according to the second embodiment of the present invention can suppress noise generated at the time of switching the traveling direction of the jet water.

Furthermore, since the jet water is directed downward at the time of supplying the water into the tank 20, the jet water travels in the water possibly present downward inside of the tank 20 (arrow AR4 in FIG. 11) even after the water inside of the tank 20 is supplied to the toilet body 10. Resistance of the water inside of the tank 20 is thereby applied to the jet water and the jet water is decelerated. By decelerating the jet water, it is possible to suppress the jet water from disturbing a water surface inside of the tank 20 and projecting from the water surface inside of the tank 20, and to suppress the noise resulting from these factors.

As described so far, the flush toilet apparatus FT according to the second embodiment can suppress the noise generated at the time of supplying the water into the tank 20.

A flush toilet apparatus according to a third embodiment of the present invention is described. In the flush toilet apparatus according to the third embodiment of the present invention, a traveling-direction switching mechanism 350A that switches the jet-water supply destination from the toilet body 10 to the tank 20 differs in configuration from the traveling-direction switching mechanism 350 according to the second embodiment. The flush toilet apparatus according to the third embodiment is similar to that according to the second embodiment in configurations of the other constituent elements.

Figure 12:
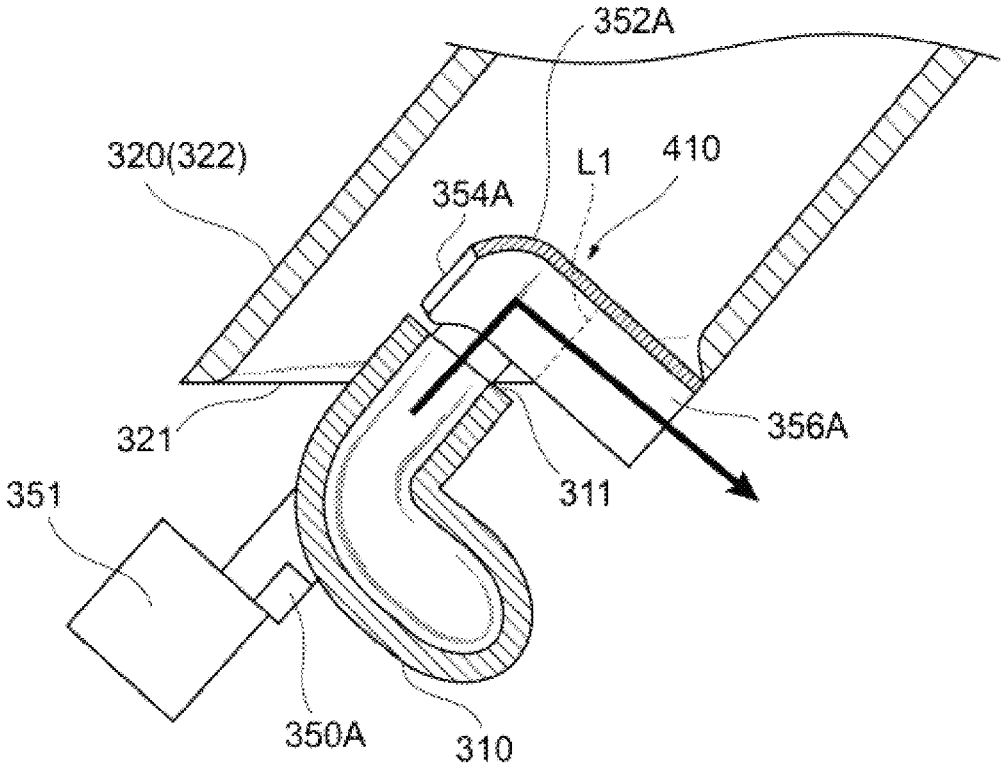
FIG. 12 is a cross-sectional view of a traveling-direction switching mechanism of a flush toilet apparatus according to a third embodiment of the present invention.

FIG. 12 is a cross-sectional view of the traveling-direction switching mechanism 350A of the flush toilet apparatus according to the third embodiment of the present invention.

As shown in FIG. 12, the traveling-direction switching mechanism 350A, which is a rod member, includes the float member 351 on one end along a longitudinal direction of the traveling-direction switching mechanism 350A and a shield portion 352A on the other end thereof. A portion between the float member 351 and the shield portion 352A of the traveling-direction switching mechanism 350A is rotatably attached to the neighborhood of the lower end of the rising portion 322.

An air-contact suppression portion 410 that suppresses the jet water from contacting the air present inside of the throat pipe 320 at the time of supplying the water into the tank 20 is provided in the traveling-direction switching mechanism 350A.

While this air-contact suppression portion 410 may be provided either integrally with or separately from the shield portion 352A, the air-contact suppression portion 410 is integral with the shield portion 352A in the third embodiment by way of example. The air-contact suppression portion 410 is a portion longer than the shield portion 352 according to the second embodiment, i.e., portion obtained by extending the shield portion 352 in a direction parallel to the traveling direction of the jet water (a portion on the right side of a dotted line L1 in the shield portion 352A shown in FIG. 12) after the switching at the time of supplying the water into the tank 20. As a result, one end 354A of the shield portion 352A faces the nozzle 310 and the other end 356A thereof faces the throat pipe 320 so as to close the suction port 321 between the nozzle 310 and an inner wall surface of the throat pipe 320.

Figure 13:
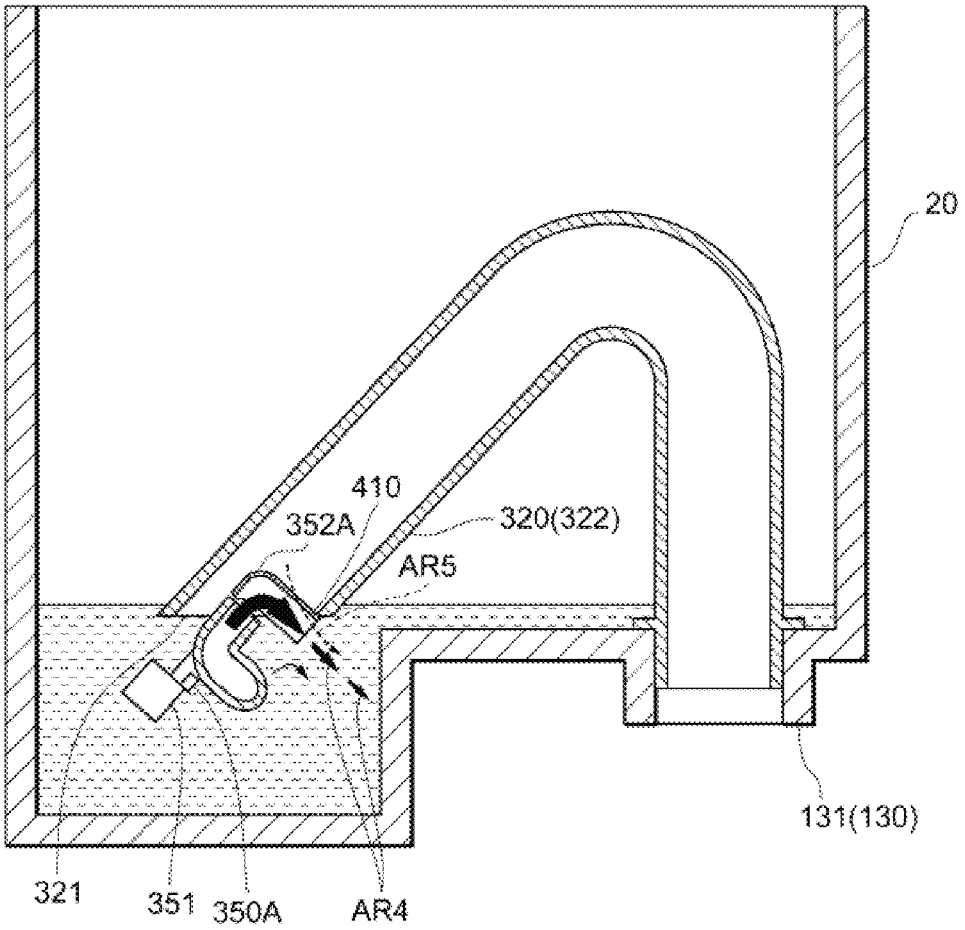
FIG. 13 is a schematic diagram showing a state in the tank at the time of supplying the water into the tank right after the traveling-direction switching mechanism switches the jet-water supply destination from the toilet body to the tank in the flush toilet apparatus according to the third embodiment.

FIG. 13 is a schematic diagram showing a state in the tank 20 at the time of supplying the water into the tank 20 right after the traveling-direction switching mechanism 350A according to the third embodiment switches the jet-water supply destination from the toilet body 10 to the tank 20.

Provided that the air-contact suppression portion 410 is not provided in the traveling-direction switching mechanism 350A, then the jet water contacts the air inside of the throat pipe 320 at the time of supplying the water into the tank 20 because of the high flow velocity and draws in the air inside of the throat pipe 320 by suction (dotted arrow AR5 in FIG. 13), resulting in the generation of the noise.

In the third embodiment of the present invention, by contrast, the air-contact suppression portion 410 serves as a shield against the suction indicated by dotted arrow AR5 and suppresses the jet water from contacting the air inside of the throat pipe 320. Therefore, it is possible to make it difficult to draw in the air inside of the throat pipe 320 by suction and to suppress the noise generated by the suction of the air.

A flush toilet apparatus according to a fourth embodiment of the present invention is described. In the flush toilet apparatus according to the fourth embodiment of the present invention, a traveling-direction switching mechanism 350B that switches the jet-water supply destination from the toilet body 10 to the tank 20 differs in configuration from the traveling-direction switching mechanism 350A according to the third embodiment. The flush toilet apparatus according to the fourth embodiment is similar to that according to the third embodiment in configurations of the other constituent elements.

Figure 14:
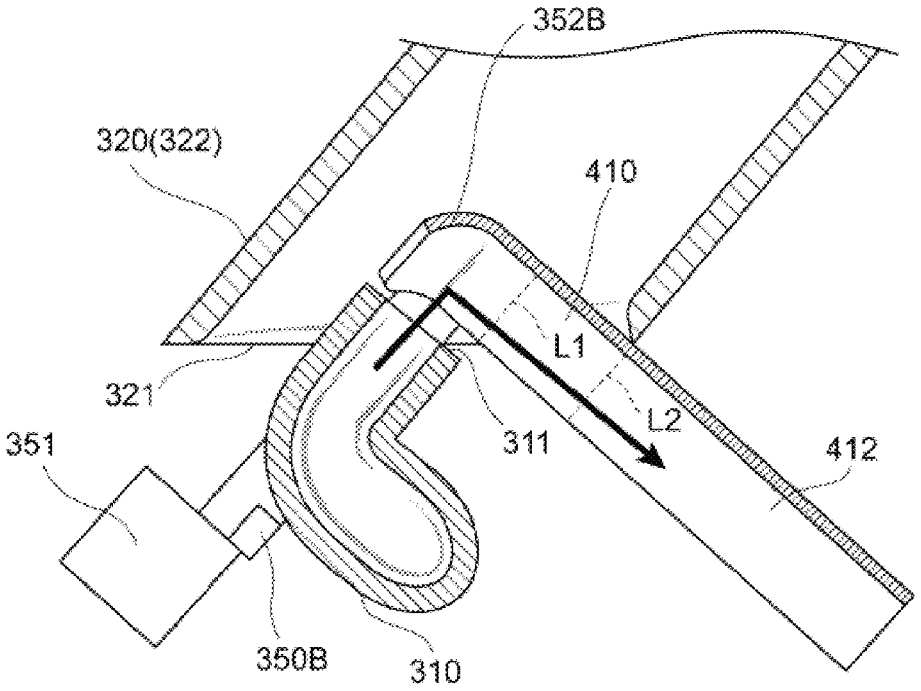
FIG. 14 is a cross-sectional view of a traveling-direction switching mechanism of a flush toilet apparatus according to a fourth embodiment of the present invention.

FIG. 14 is a cross-sectional view of the traveling-direction switching mechanism 350B of the flush toilet apparatus according to the fourth embodiment of the present invention.

As shown in FIG. 14, the traveling-direction switching mechanism 350B, which is a rod member, includes the float member 351 on one end along a longitudinal direction of the traveling-direction switching mechanism 350B and a shield portion 352B on the other end thereof. A portion between the float member 351 and the shield portion 352B of the traveling-direction switching mechanism 350B is rotatably attached to the neighborhood of the lower end of the rising portion 322.

The air-contact suppression portion 410 identical to that according to the third embodiment is provided in the traveling-direction switching mechanism 350B.

A water-surface-falling suppression portion 412 that suppresses the water surface inside of the tank 20 from falling by the jet water is provided in a tip end portion of this air-contact suppression portion 410.

While this water-surface-falling suppression portion 412 may be provided either integrally with or separately from the shield portion 352B, the water-surface-falling suppression portion 412 is integral with the shield portion 352B in the fourth embodiment by way of example. The water-surface-falling suppression portion 412 is a tank-water-contact suppression portion that is a portion longer than the shield portion 352A according to the third embodiment, i.e., portion obtained by extending the shield portion 352A in a direction parallel to the traveling direction of the jet water (a portion on the right side of a dotted line L2 in the shield portion 352B shown in FIG. 14) after the switching at the time of supplying the water into the tank 20. As a result, the water-surface-falling suppression portion 412 suppresses the jet water from contacting the water present above the jet water inside of the tank 20 at the time of supplying the water into the tank 20.

Figure 15:
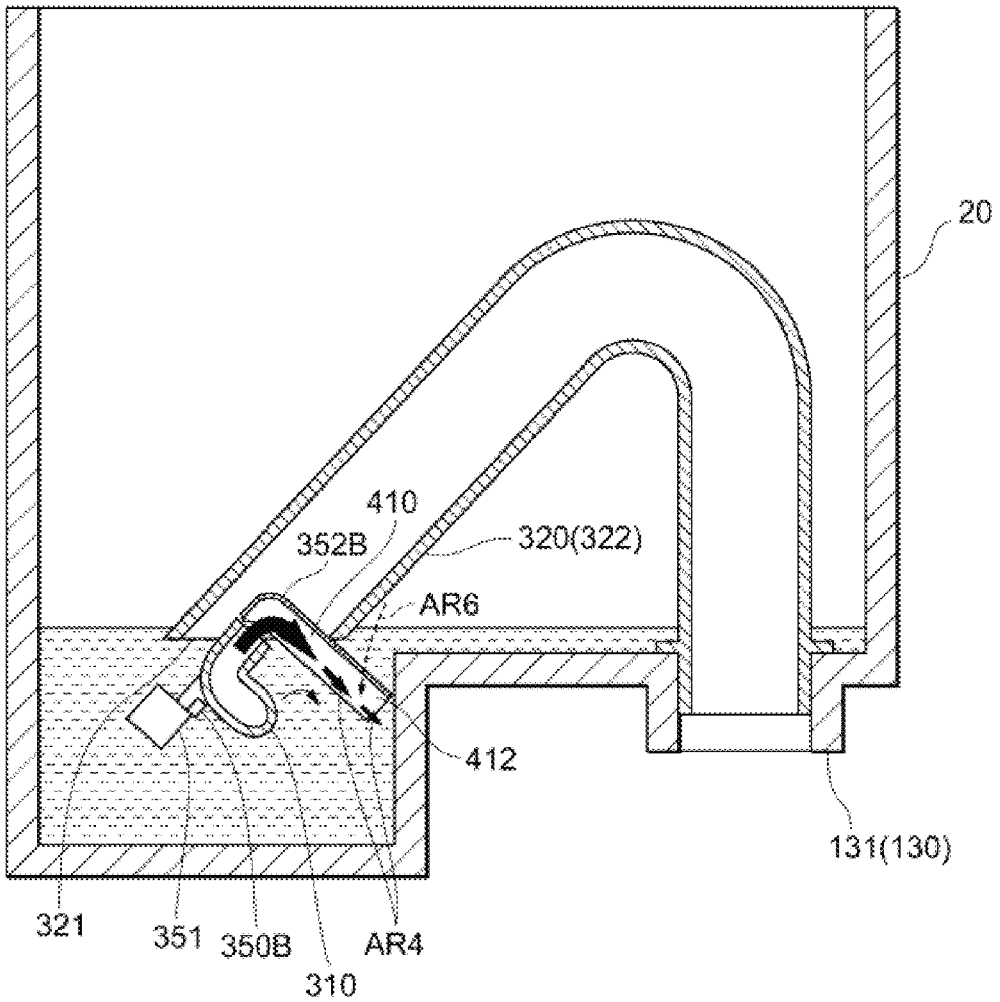
FIG. 15 is a schematic diagram showing a state in the tank at the time of supplying the water into the tank right after the traveling-direction switching mechanism switches the jet-water supply destination from the toilet body to the tank in the flush toilet apparatus according to the fourth embodiment.

FIG. 15 is a schematic diagram showing a state in the tank 20 at the time of supplying the water into the tank 20 right after the traveling-direction switching mechanism 350B switches the jet-water supply destination from the toilet body 10 to the tank 20 in the flush toilet apparatus according to the fourth embodiment of the present invention.

According to the conventional technique, the jet water draws in the surrounding water while traveling in the water stored in the tank 20 at the time of supplying the water into the tank 20 because of the high flow velocity, the water surface inside of the tank 20 falls, and the jet water draws in the air present outside of the throat pipe 320 by suction (dotted arrow AR6 in FIG. 15), possibly resulting in the generation of the noise.

In the flush toilet apparatus according to the fourth embodiment of the present invention, by contrast, the water-surface-falling suppression portion 412 serves as a shield against the suction indicated by dotted arrow AR6 and suppresses the jet water from contacting the water present above the jet water inside of the tank 20. It is thereby possible to suppress the water surface from falling by the jet water traveling in the water inside of the tank 20. As a result, it is possible to make it difficult for the jet water to draw in the air outside of the throat pipe 320 by suction and to suppress the noise generated by the suction of the air.

A flush toilet apparatus according to a fifth embodiment of the present invention is described. In the flush toilet apparatus according to the fifth embodiment of the present invention, a throat pipe 320 differs in configuration from the throat pipe 320 according to the third embodiment. The flush toilet apparatus according to the fifth embodiment is similar to that according to the third embodiment in the configurations of the other constituent elements.

Figure 16:
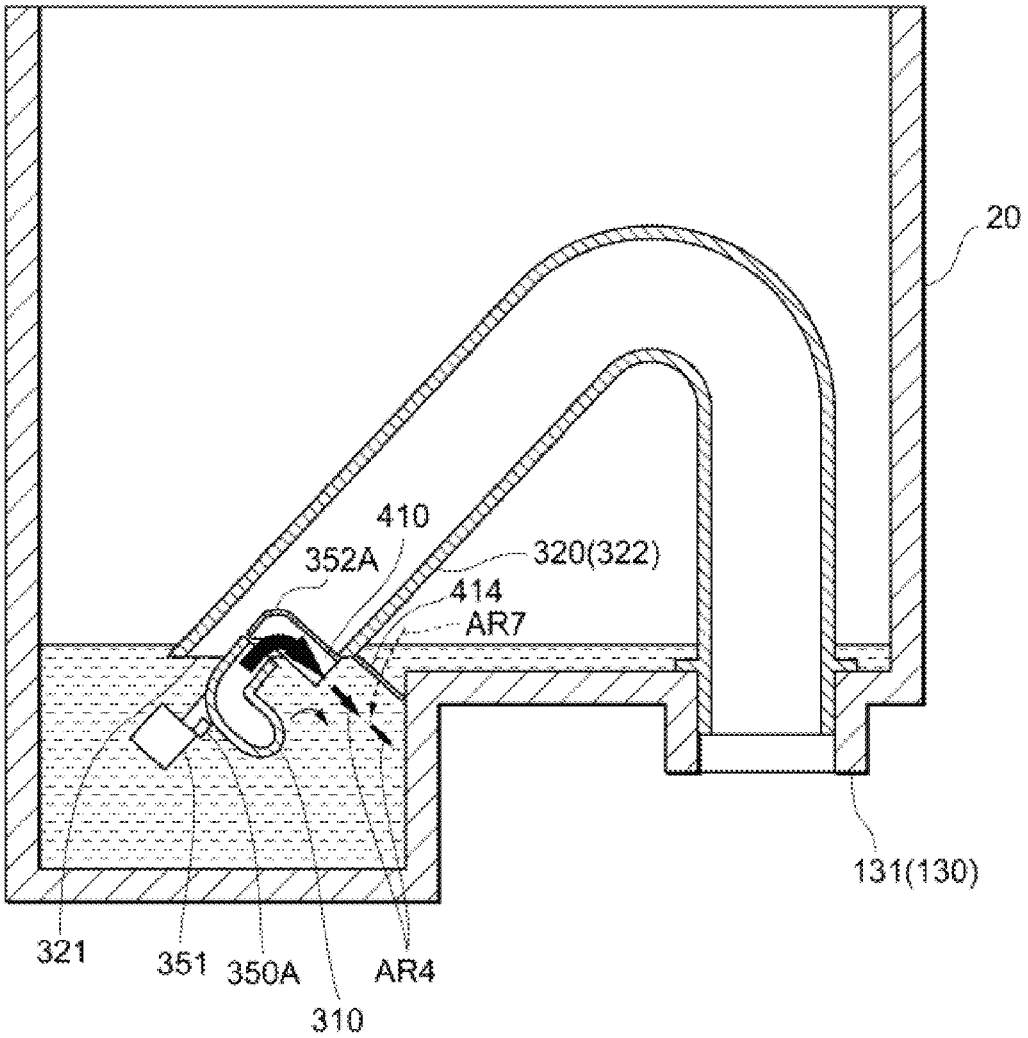
FIG. 16 is a schematic diagram showing a state in the tank at the time of supplying the water into the tank right after a traveling-direction switching mechanism switches the jet-water supply destination from the toilet body to the tank in a flush toilet apparatus according to a fifth embodiment of the present invention.

FIG. 16 is a schematic diagram showing a state in the tank 20 at the time of supplying the water into the tank 20 right after the traveling-direction switching mechanism 350A switches the jet-water supply destination from the toilet body 10 to the tank 20 in the flush toilet apparatus according to the fifth embodiment.

The throat pipe 320 of the flush toilet apparatus according to the fifth embodiment of the present invention is obtained by further adding a water-surface-falling suppression portion 414 that suppresses the water surface inside of the tank 20 from falling by the jet water to the configuration of the throat pipe 320 according to the third embodiment.

This water-surface-falling suppression portion 414 is a tank-water-contact suppression portion attached to an end portion of the throat pipe 320 near the suction port 321 and extending along an extension direction of the shield portion 352A (traveling direction of the jet water after the switching). As a result, the water-surface-falling suppression portion 414 suppresses the jet water from contacting the water present above the jet water inside the tank 20 at the time of supplying the water into the tank 20.

According to the conventional technique, the jet water draws in the surrounding water while traveling in the water stored in the tank 20 at the time of supplying the water into the tank 20 because of the high flow velocity, the water surface inside of the tank 20 falls, and the jet water draws in the air present outside of the throat pipe 320 by suction (dotted arrow AR7 in FIG. 16), possibly resulting in the generation of the noise.

In the flush toilet apparatus according to the fifth embodiment of the present invention, by contrast, the water-surface-falling suppression portion 414 serves as a shield against the suction indicated by dotted arrow AR7 and suppresses the jet water from contacting the water present above the jet water inside of the tank 20. It is thereby possible to suppress the water surface from falling by the jet water traveling in the water inside of the tank 20. As a result, it is possible to make it difficult for the jet water to draw in the air outside of the throat pipe 320 by suction and to suppress the noise generated by the suction of the air.

A flush toilet apparatus according to a sixth embodiment of the present invention is described. In the flush toilet apparatus according to the sixth embodiment of the present invention, the tank 20 differs in configuration from the tank 20 according to the third embodiment. The flush toilet apparatus according to the sixth embodiment is similar to that according to the third embodiment in the configurations of the other constituent elements.

Figure 17:
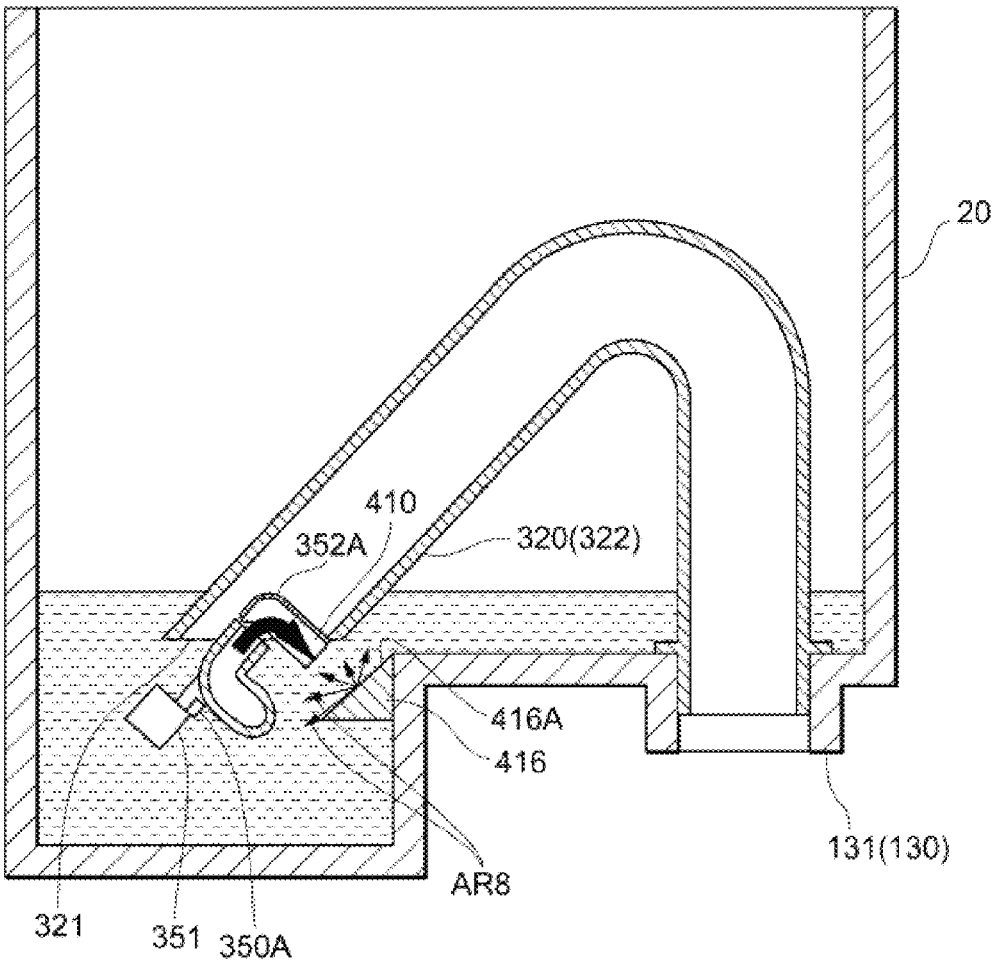
FIG. 17 is a schematic diagram showing a state in the tank at the time of supplying the water into the tank right after a traveling-direction switching mechanism switches the jet-water supply destination from the toilet body to the tank in a flush toilet apparatus according to a sixth embodiment of the present invention.

FIG. 17 is a schematic diagram showing a state in the tank 20 at the time of supplying the water into the tank 20 right after the traveling-direction switching mechanism 350A switches the jet-water supply destination from the toilet body 10 to the tank 20 in the flush toilet apparatus according to the sixth embodiment.

The tank 20 of the flush toilet apparatus according to the sixth embodiment of the present invention is obtained by further adding a water-surface-falling suppression portion 416 that suppresses the water surface inside of the tank 20 from falling by the jet water to the configuration of the tank 20 according to the third embodiment.

This water-surface-falling suppression portion 416 is an underwater mixing portion of a triangle pole shape that is attached to an inner wall of the tank 20 present ahead of the traveling direction of the jet water after the switching and that includes, for example, an orthogonal surface 416A orthogonal to the traveling direction of the jet water. As a result, the water-surface-falling suppression portion 416 strikes the jet water against the orthogonal surface 416A and mixes the jet water underwater at the time of supplying the water into the tank 20.

In the flush toilet apparatus according to the sixth embodiment of the present invention, the water-surface-falling suppression portion 416 serving as the underwater mixing portion that mixes the jet water underwater is provided, whereby the jet water loses a directivity when striking against the underwater mixing portion at the time of supplying the water into the tank 20 (arrow AR8 in FIG. 17). It is thereby possible to suppress the jet water from drawing in the water inside of the tank 20 and the water surface in the tank 20 from falling. As a result, it is possible to make it difficult to draw in the air outside of the throat pipe 320 by suction and to suppress the noise generated by the suction of the air.

While a plurality of embodiments of the present embodiment have been described so far while referring to specific examples, the present invention is not limited to these specific examples. That is, these specific examples of which appropriate design changes are made by those skilled in the art also fall within the scope of the present invention as long as the changed examples include features of the present invention. For example, the respective constituent elements of each of the specific examples as well as arrangements, materials, conditions, shapes, sizes, and the like of the respective constituent elements are not limited to those exemplarily described but can be appropriately changed. Furthermore, the constituent elements of the respective embodiments can be used in combinations as long as the combinations are technically possible, and these combinations also fall within the scope of the present invention as long as the combinations include the features of the present invention.

What is claimed is:

1. A flush toilet apparatus for discharging waste to a drain pipe by wash water, comprising:

a toilet body including a bowl portion that receives the waste; and a water conduit for introducing water supplied as the wash water to the bowl portion;

a tank storing therein water, and provided to allow supply of the water to the water conduit; and a jet pump unit arranged in a state in which at least a part of the jet pump unit is submerged inside of the tank, wherein the jet pump unit includes:

a throat pipe having a suction port formed in one end portion of the throat pipe, and arranged in such a manner that the water flowing into the throat pipe from the suction port is supplied to the water conduit;

a nozzle triggering a jet pump action by injecting jet water at a high flow velocity toward inside of the throat pipe from the suction port; and a traveling-direction switching mechanism switching a mode between a toilet washing mode for supplying the jet water to the water conduit and a tank storage mode for supplying the jet water into the tank by switching a traveling direction of the jet water from the inside of the throat pipe to an outside of the throat pipe, the traveling-direction switching mechanism includes:

a shield portion switching the traveling direction of the jet water to the outside of the throat pipe by shielding the traveling jet water at a time of the tank storage mode; and a moving mechanism moving the shield portion from a position at a time of the toilet washing mode in a first direction to a position at the time of the tank storage mode, and the shield portion includes a guide surface switching the traveling direction of the jet water so that after the traveling direction is switched during the process of switching from the toilet washing mode to the tank storage mode, a flow rate of the jet water is higher in a second direction opposite to the first direction than in the first direction, and the guide surface has: a strike portion against which the jet water injected from the nozzle strikes; a block portion blocking the side of the strike portion in the first direction; and an opening portion opening the side of the strike portion in the second direction; in order that the jet water is suppressed to travel in the first direction and the jet water travel in the second direction during and after the process of the traveling-direction switching.

2. The flush toilet apparatus according to claim 1, wherein the guide surface is provided in an end portion in the first direction side of the shield portion so that after the traveling direction is switched, almost all the jet water travels in the second direction.

3. The flush toilet apparatus according to claim 1, wherein the guide surface is formed to have a concave cross-section so as to suppress diffusion of the jet water after the traveling direction is switched.

4. The flush toilet apparatus according to claim 1, wherein the guide surface extends to have a curve shape so as to suppress deceleration of the jet water resulting from switching of the traveling direction of the jet water.

5. The flush toilet apparatus according to claim 1, wherein the guide surface is configured to switch the traveling direction of the jet water to the outside of the throat pipe without disturbing a flow of the jet water injected from the nozzle at a time of supplying the water into the tank by switching the traveling direction.

6. The flush toilet apparatus according to claim 5, wherein the guide surface is configured to direct the jet water downward in the tank, the traveling direction of the jet water being switched.

7. The flush toilet apparatus according to claim 6, wherein the traveling-direction switching mechanism includes an air-contact suppression portion suppressing the jet water from contacting the air present inside of the throat pipe at the time of supplying the water into the tank.

8. The flush toilet apparatus according to claim 7, wherein the tank includes a water-surface-falling suppression portion suppressing a water surface in the tank from falling by the jet water at the time of supplying the water into the tank.

9. The flush toilet apparatus according to claim 8, wherein the water-surface-falling suppression portion includes a tank-water-contact suppression portion suppressing the jet water from contacting the water present above the jet water inside of the tank at the time of supplying the water into the tank.

10. The flush toilet apparatus according to claim 8, wherein the water-surface-falling suppression portion includes an underwater mixing portion mixing the jet water underwater at the time of supplying the water into the tank.

11. A flush toilet apparatus for discharging waste to a drain pipe by wash water, comprising:

a toilet body including a bowl portion that receives the waste; and a water conduit for introducing water supplied as the wash water to the bowl portion;

a tank storing therein water, and provided to allow supply of the water to the water conduit; and a jet pump unit arranged in a state in which at least a part of the jet pump unit is submerged inside of the tank, wherein the jet pump unit includes:

a throat pipe having a suction port formed in one end portion of the throat pipe, and arranged in such a manner that the water flowing into the throat pipe from the suction port is supplied to the water conduit;

a nozzle triggering a jet pump action by injecting jet water at a high flow velocity toward inside of the throat pipe from the suction port; and a traveling-direction switching mechanism switching a mode between a toilet washing mode for supplying the jet water to the water conduit and a tank storage mode for supplying the jet water into the tank by switching a traveling direction of the jet water from the inside of the throat pipe to an outside of the throat pipe, the traveling-direction switching mechanism includes:

a shield portion switching the traveling direction of the jet water to the outside of the throat pipe by shielding the traveling jet water at a time of the tank storage mode; and a moving mechanism moving the shield portion from a position at a time of the toilet washing mode in a first direction to a position at the time of the tank storage mode, and the shield portion includes a guide surface switching the traveling direction of the jet water so that after the traveling direction is switched during the process of switching from the toilet washing mode to the tank storage mode, a flow rate of the jet water is higher in a second direction opposite to the first direction than in the first direction, and the guide surface is generally L-shaped in order that the jet water is suppressed to travel in the first direction and the jet water travel in the second direction during and after the process of the traveling-direction switching.

12. The flush toilet apparatus according to claim 11, wherein the guide surface extends to have a curved shape.

13. A flush toilet apparatus for discharging waste to a drain pipe by wash water, comprising:

a toilet body including a bowl portion that receives the waste; and a water conduit for introducing water supplied as the wash water to the bowl portion;

a tank storing therein water, and provided to allow supply of the water to the water conduit; and a jet pump unit arranged in a state in which at least a part of the jet pump unit is submerged inside of the tank, wherein the jet pump unit includes:

a throat pipe having a suction port formed in one end portion of the throat pipe, and arranged in such a manner that the water flowing into the throat pipe from the suction port is supplied to the water conduit;

a nozzle triggering a jet pump action by injecting jet water at a high flow velocity toward inside of the throat pipe from the suction port; and a traveling-direction switching mechanism switching a mode between a toilet washing mode for supplying the jet water to the water conduit and a tank storage mode for supplying the jet water into the tank by switching a traveling direction of the jet water from the inside of the throat pipe to an outside of the throat pipe, the traveling-direction switching mechanism includes:

a shield portion switching the traveling direction of the jet water to the outside of the throat pipe by shielding the traveling jet water at a time of the tank storage mode; and a moving mechanism moving the shield portion from a position at a time of the toilet washing mode in a first direction to a position at the time of the tank storage mode, and the shield portion includes a guide surface switching the traveling direction of the jet water so that after the traveling direction is switched during the process of switching from the toilet washing mode to the tank storage mode, a flow rate of the jet water is higher in a second direction opposite to the first direction than in the first direction, and the guide surface has a concave curved portion in order that the jet water is suppressed to travel in the first direction and the jet water travel in the second direction during and after the process of the traveling-direction switching.

* * * * *